US010522978B2

(12) United States Patent
Tamida et al.

(10) Patent No.: US 10,522,978 B2
(45) Date of Patent: Dec. 31, 2019

(54) IGNITION PLUG AND IGNITION SYSTEM INCLUDING THE SAME

(71) Applicants: Mitsubishi Electric Corporation, Chiyoda-ku (JP); NGK SPARK PLUG CO., LTD., Nagoya-shi (JP)

(72) Inventors: Taichiro Tamida, Chiyoda-ku (JP); Takahiro Inoue, Chiyoda-ku (JP); Takashi Hashimoto, Chiyoda-ku (JP); Akira Nakagawa, Chiyoda-ku (JP); Tomokazu Sakashita, Chiyoda-ku (JP); Takayoshi Nagai, Chiyoda-ku (JP); Kimihiko Tanaya, Chiyoda-ku (JP); Hiroyuki Kameda, Nagoya (JP); Yuichi Yamada, Nagoya (JP); Kenji Ban, Nagoya (JP)

(73) Assignees: Mitsubishi Electric Corporation, Chiyoda-ku (JP); NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/769,120

(22) PCT Filed: Oct. 7, 2016

(86) PCT No.: PCT/JP2016/079898
§ 371 (c)(1),
(2) Date: Apr. 18, 2018

(87) PCT Pub. No.: WO2017/110209
PCT Pub. Date: Jun. 29, 2017

(65) Prior Publication Data

US 2018/0301877 A1 Oct. 18, 2018

(30) Foreign Application Priority Data

Dec. 24, 2015 (JP) ..... 2015-250927

(51) Int. Cl.
*H01T 13/32* (2006.01)
*F02P 3/01* (2006.01)
(Continued)

(52) U.S. Cl.
CPC ..... *H01T 13/32* (2013.01); *F02B 23/08* (2013.01); *F02P 3/01* (2013.01); *F02P 5/145* (2013.01); *F02P 13/00* (2013.01)

(58) Field of Classification Search
CPC ..... H01T 13/00; H01T 13/32; H01T 13/34; H01T 13/50; H01T 13/52; H01T 13/54;
(Continued)

(56) References Cited

U.S. PATENT DOCUMENTS 4,439,707 A * 3/1984 Hattori ..... H01T 13/39 313/130
9,391,431 B2 * 7/2016 Okabe ..... H01T 13/52
(Continued)

FOREIGN PATENT DOCUMENTS

JP 2009-036125 A 2/2009
JP 2012-184718 A 9/2012
(Continued)

OTHER PUBLICATIONS

Extended European Search Report dated Oct. 31, 2018 in Patent Application No. 16876107.8, citing documents AA-AB & AO therein, 8 pages.
(Continued)

*Primary Examiner* — Hai H Huynh
(74) *Attorney, Agent, or Firm* — Oblon, McClelland, Maier & Neustadt, L.L.P.

(57) ABSTRACT

In an ignition plug, since a ground electrode is formed in a thin-rod-shape or a mesh-like shape, sufficiently strong radicals are locally generated by a barrier discharge, an anti-inflammation effect by the electrode is small, and the
(Continued)

growth of a flame is hardly hindered. Furthermore, by making the thickness dimension of a second dielectric facing a discharge region uniform, the barrier discharge is spread over the surface of the second dielectric, the generation of the radicals is maintained, and combustibility after ignition is promoted. Furthermore, because an end portion of a high voltage electrode and a ground electrode are disposed to face each other within a combustion chamber, a fuel gas introduced into the combustion chamber is liable to flow into the discharge region, and is easily ignited by the radicals generated due to the discharge.

23 Claims, 21 Drawing Sheets

(51) Int. Cl.
*F02B 23/08* (2006.01)
*F02P 13/00* (2006.01)
*F02P 5/145* (2006.01)

(58) Field of Classification Search
CPC ..... H01T 13/467; H05H 1/2406; H05H 2001/2412; H05H 2001/2418; F02P 23/04; F02P 5/145; F02P 3/01; F02P 13/00; F02P 15/10; F02B 23/08
USPC ..... 123/169
See application file for complete search history.

(56) References Cited

U.S. PATENT DOCUMENTS

| | | | | |
|---|---|---|---|---|
| 9,979,162 | B2 * | 5/2018 | Kasahara | H01T 13/04 |
| 2009/0031988 | A1 | 2/2009 | Shiraishi et al. | |
| 2014/0144402 | A1 | 5/2014 | Okabe et al. | |
| 2014/0174416 | A1 | 6/2014 | Okabe et al. | |
| 2015/0144115 | A1 | 5/2015 | Kosuge et al. | |
| 2016/0305393 | A1 | 10/2016 | Idicheria et al. | |

FOREIGN PATENT DOCUMENTS

| | | | |
|---|---|---|---|
| JP | 2014-123435 | A | 7/2014 |
| JP | 2014-182907 | A | 9/2014 |
| JP | 5691662 | B2 | 4/2015 |
| JP | 2015-103499 | A | 6/2015 |
| WO | WO 2015/130655 | A1 | 9/2015 |

OTHER PUBLICATIONS

Combined Chinese Office Action and Search Report dated May 15, 2019 in Patent Application No. 201680073742.4, 21 pages (with unedited computer generated English translation of the Office Action and English Translation of Category of Cited Documents).
Office Action dated Sep. 18, 2018 in Japanese Patent Application No. 2017-557752, (with unedited computer generated English translation), 6 pages.
International Search Report dated Nov. 1, 2016 in PCT/JP2016/079898, filed on Oct. 7, 2016.

* cited by examiner

FIG. 18
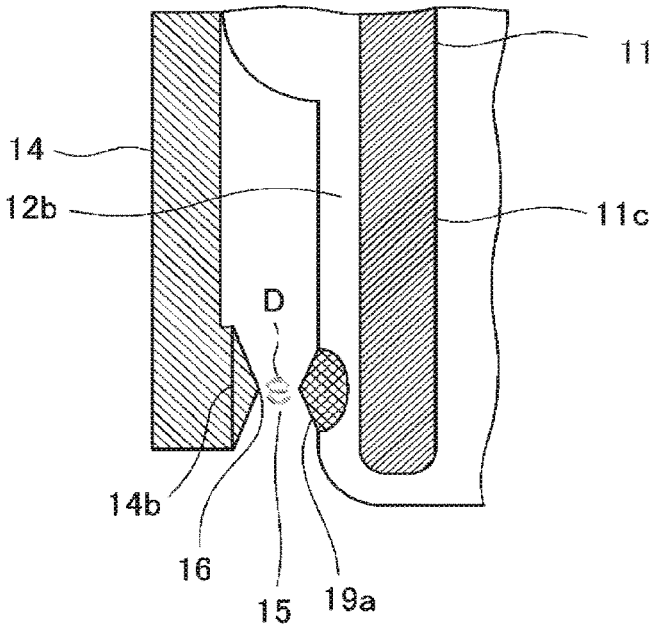
FIG. 19
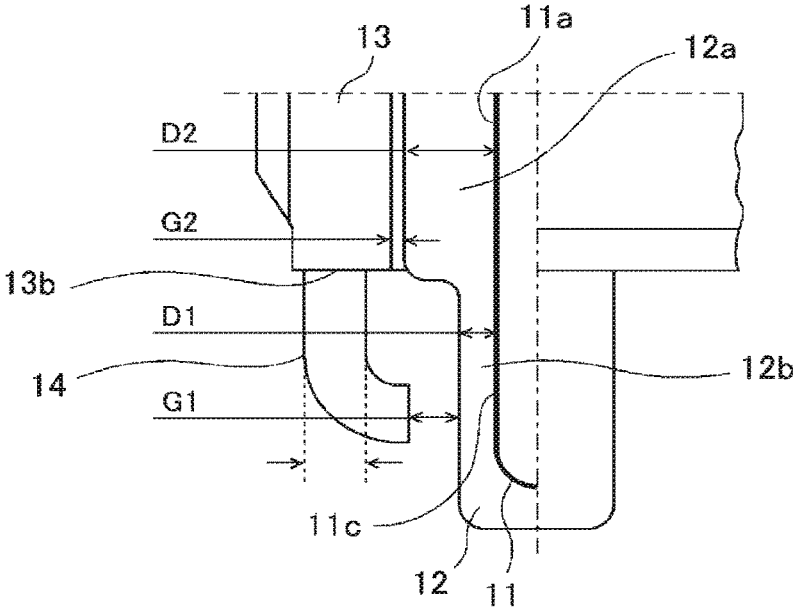
FIG. 20
| G2 | 0.1 | 0.3 | 0.5 | 0.7 | 0.9 | 1.1 | 1.3 | 1.5 |
|---|---|---|---|---|---|---|---|---|
| IGNITION PERFORMANCE | ○ | ○ | × | × | × | × | × | × |
※ IGNITION PERFORMANCE : IGNITION○, MISS-IGNITION ×

FIG. 21
| | | D1 (mm) | | | | | |
|---|---|---|---|---|---|---|---|
| | | 0.3 | 0.6 | 0.8 | 1.2 | 1.5 | 1.8 |
| G1 (mm) | 0.6 | × | ○ | ○ | ○ | ○ | ○ |
| | 0.8 | × | ○ | ○ | ○ | ○ | ○ |
| | 1.1 | × | ○ | ○ | ○ | ○ | ○ |
| | 1.5 | × | ○ | ○ | ○ | ○ | ○ |
※ PENETRATION OF DIELECTRIC : NON-PENETRATED○, PENETRATED ×
FIG. 22
| | | D1 (mm) | | | | | |
|---|---|---|---|---|---|---|---|
| | | 0.3 | 0.6 | 0.8 | 1.2 | 1.5 | 1.8 |
| G1 (mm) | 0.6 | × | × | × | × | × | × |
| | 0.8 | ○ | ○ | ○ | ○ | × | × |
| | 1.1 | ○ | ○ | ○ | ○ | × | × |
| | 1.5 | ○ | ○ | ○ | ○ | × | × |
※ IGNITION PERFORMANCE : IGNITION○, MISS-IGNITION ×
FIG. 23A
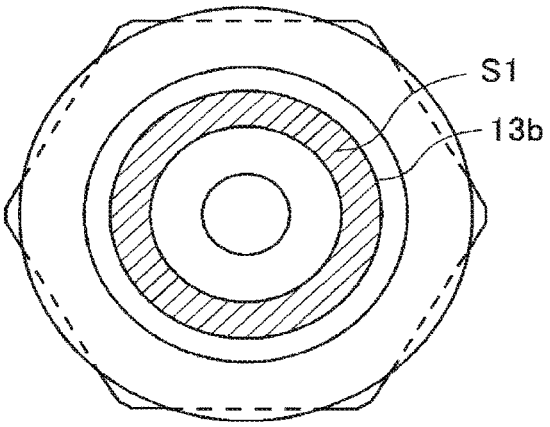
FIG. 23B
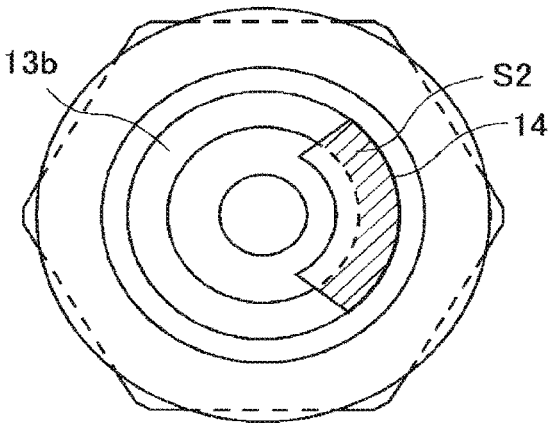
FIG. 24
| | | S2/S1 | | | | | | |
|---|---|---|---|---|---|---|---|---|
| | | 0.10 | 0.15 | 0.20 | 0.25 | 0.30 | 0.35 | 0.40 |
| A/F | 20 | ○ | ○ | ○ | ○ | ○ | ○ | ○ |
| | 22 | × | ○ | ○ | ○ | ○ | ○ | × |
| | 24 | × | × | × | × | × | × | × |
※ IGNITION PERFORMANCE : IGNITION○, MISS-IGNITION ×

FIG. 25
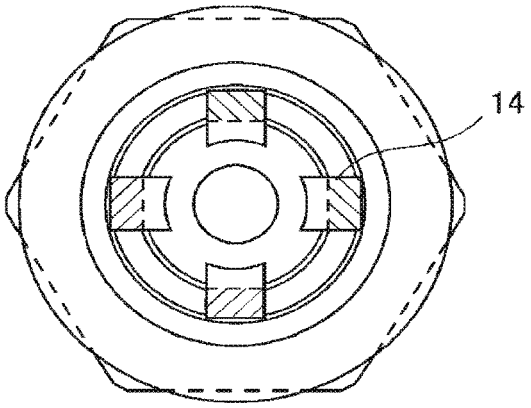
FIG. 26
| S2/S1=0.15 | | NUMBER OF DIVISION | | |
|---|---|---|---|---|
| | | 1 | 2 | 4 |
| A/F | 20 | ○ | ○ | ○ |
| | 22 | ○ | ○ | ○ |
| | 24 | × | ○ | ○ |
※ IGNITION PERFORMANCE : IGNITION○, MISS-IGNITION ×
FIG. 27
| S2/S1=0.35 | | NUMBER OF DIVISION | | |
|---|---|---|---|---|
| | | 1 | 2 | 4 |
| A/F | 20 | ○ | ○ | ○ |
| | 22 | ○ | ○ | ○ |
| | 24 | × | ○ | ○ |
※ IGNITION PERFORMANCE : IGNITION○, MISS-IGNITION ×
FIG. 28A
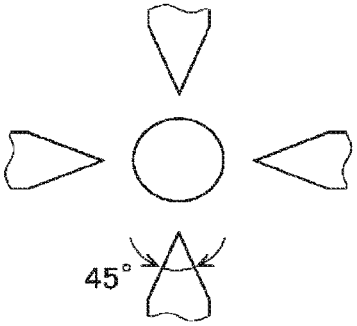
FIG. 28B
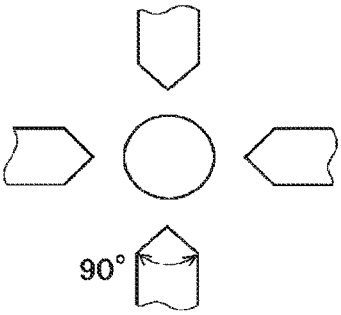
FIG. 28C
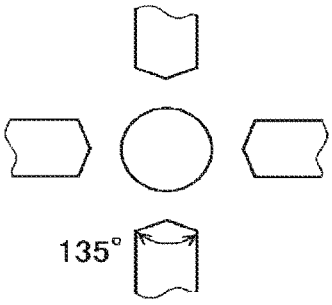

FIG. 29
| | | ANGLE OF TIP END | | |
|---|---|---|---|---|
| | | 45° | 90° | 135° |
| A/F | 24 | ○ | ○ | ○ |
| | 26 | ○ | ○ | × |
※ IGNITION PERFORMANCE : IGNITION○, MISS-IGNITION×
FIG. 30A
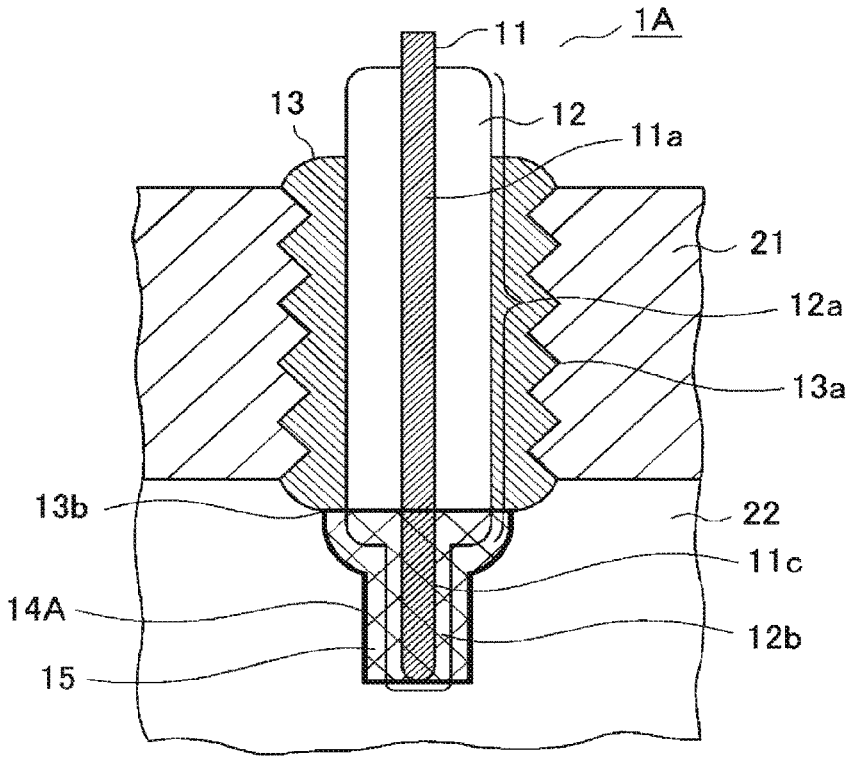
FIG. 30B
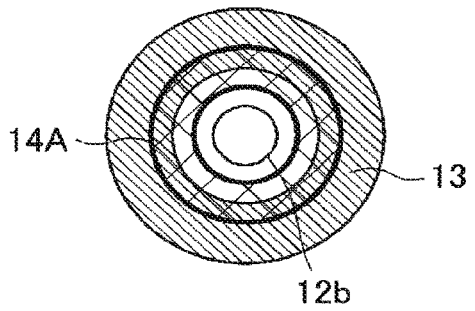

IGNITION PLUG AND IGNITION SYSTEM INCLUDING THE SAME

TECHNICAL FIELD

The present invention relates to an ignition plug that uses a dielectric barrier discharge and an ignition system that includes the ignition plug.

BACKGROUND ART

Regarding a gasoline engine, demand for reduction in fuel consumption is extremely great in terms of the reduction of $CO_2$ or a great increase in gasoline price, and an attempt for improvement of fuel efficiency has been made using a technology such as lean combustion or exhaust gas recirculation. However, either one has a problem of defective ignition. In a spark plug used for a current gasoline engine, a high voltage pulse is applied between electrodes such that thermal plasma is generated by an arc discharge, and the fuel is ignited by the thermal plasma.

In contrast, practical use of a volumetrically high-efficient ignition method using low-temperature plasma has been proposed as a technology for improving the ignition stability. The low-temperature plasma refers to plasma in a non-equilibrium state where an electron temperature is high but an ion or neutral-particle temperature is low, and is characterized in that the low-temperature plasma, enables a multi-point simultaneous ignition which occupies a high, volume, that is, a volumetric ignition to be performed. By using the low-temperature plasma, it is possible to hinder consumption of the ignition plug, and because the production amount of radicals (active particles that are generated due to a discharge and serve as combustion initiation points) is large, it is possible to facilitate combustibility after ignition.

The low-temperature plasma is generated, by a barrier discharge, a corona discharge, a streamer discharge, or the like. Among them, the barrier discharge that is an alternating current discharge generated using a dielectric interposed between electrodes is a technique capable of stably generating the low-temperature plasma since a non-equilibrium discharge can be maintained over a wide electrode surface area.

In the barrier discharge, because thin-pillar-like minute streamer discharges are generated intermittently and evenly on an electrode surface, the low-temperature plasma can be generated uniformly in a wide range. On the other hand, because energy input by plasma, spreads throughout into the entire discharge space, input energy per unit, area is low. That is, although the barrier discharge may efficiently generate radicals, it can be said that the barrier discharge is a technique in which the radicals are uniformly distributed and tend to be diluted.

As the related art applying the barrier discharge to engine ignition, Patent Literature 1 proposes an ignition device in which an annular electrode is concentrically arranged outside a cylindrical dielectric electrode in which a rod-shaped center electrode is covered with a dielectric layer. In this example, the outer annular electrode is grounded and high-voltage alternating current waveforms are applied to the center electrode. Thus, the barrier discharge is caused to occur in a concentric electric field between the dielectric electrode and the annular electrode.

CITATION LIST

Patent Literature

Patent Literature 1: Japanese Laid-open Patent Publication No. 2009-036125

SUMMARY OF INVENTION

Technical Problem

In the ignition device disclosed in Patent Literature 1, the barrier discharge occurs uniformly between the center electrode and the annular electrode, that is, within a cylinder, and the radicals generated due to this discharge contribute to combustion. However, it is considered that the configuration in Patent Literature 1 is unsuitable for the direct ignition of fuel due to the radicals generated as the result of the barrier discharge and thus a stable ignition cannot be performed. The reason for this will be described below.

First, the configuration in Patent Literature 1 is not suitable for the direct ignition in that the cylinder as a discharge space is present within a partition wall of an engine. In order to directly ignite fuel by the barrier discharge, a fuel gas needs to flow into the discharge space and to react with the radical there. In contrast, it is considered that in the configuration in Patent Literature 1, the radicals generated in the discharge space are gradually diffused into a combustion chamber and react with the fuel. It is considered that, with this configuration, the combustion is facilitated by the radicals, but it is difficult to directly ignite the fuel.

Furthermore, in order to perform the direct ignition of fuel by the barrier discharge, a strong combustion reaction needs to occur locally, and for this purpose, sufficiently strong radicals needs to be locally generated. However, it is considered, that in the ignition device in Patent Literature 1, the barrier discharge is uniformly spread over an entire electrode surface, and the ignition device is not configured such that radicals are locally generated in a concentrated manner.

The present invention has been made to solve the problems described above, and an object of the present invention is to obtain an ignition plug and an ignition, system including the same in which a direct ignition of fuel can be stably performed using a barrier discharge and excellent ignitability and combustibility can be realized.

Solution to Problem

According to an aspect of the present invention, there is provided an ignition plug including: a cylindrical main fitting; a rod-shaped or mesh-like ground electrode connected to one end surface of the main fitting; a rod-shaped high voltage electrode, one end of which is exposed from the end surface side of the main fitting; and a first dielectric covering a peripheral surface of the high voltage electrode and held in the main fitting. Any one of the end portion of the high voltage electrode and the ground electrode is covered with a second dielectric that has a thickness dimension smaller than a thickness dimension of the first dielectric. The end portion of the high voltage electrode and the ground electrode are disposed to face each other with an discharge region facing the second dielectric being interposed therebetween, a thickness dimension of the second dielectric facing the discharge region is uniform, and, when the second dielectric covers the end portion of the high voltage electrode, an area of the ground electrode facing the discharge region is smaller than a surface area of the second dielectric facing the discharge region.

According to another aspect of the present invention, there is provided an ignition plug including: a cylindrical main fitting; a rod-shaped or mesh-like ground electrode connected to one end surface of the main fitting; a rod-shaped high voltage electrode, one end portion of which is exposed from the end surface side of the main fitting; and a first dielectric covering a peripheral surface of the high voltage electrode and held in the main fitting. Any one of the end portion of the high voltage electrode and the ground electrode is covered, with a second, dielectric having a thickness dimension smaller than a thickness dimension of the first dielectric. The end portion of the high voltage electrode and the ground electrode are disposed to face each other with an discharge region facing the second dielectric being interposed therebetween, the thickness dimension of the second, dielectric facing the discharge region is uniform, and, assuming that a distance of a gap between the first electric covering the peripheral surface of the high voltage electrode and the main fitting is G2, G2≤0.3 mm.

According to still another aspect of the present invention, there is provided an ignition plug including: a cylindrical main, fitting; a rod-shaped or mesh-like ground electrode connected to one end surface of the main fitting; a rod-shaped high voltage electrode, one end portion of which is exposed from the end surface side of the main fitting; and a first dielectric covering a peripheral surface of the high voltage electrode and held in the main fitting. Any one of the end portion of the high voltage electrode and the ground electrode is covered with a second dielectric having a thickness dimension smaller than a thickness dimension of the first dielectric. The end portion of the high voltage electrode and the ground electrode are disposed to face each other with a discharge region facing the second dielectric therebetween, and a third protrusion having a pointed end portion provided on the second dielectric at a location facing the discharge region.

According to still another aspect of the present invention, there is provided an ignition system including; the above-described ignition plug; an alternating current application unit configured to apply an alternating current voltage between the high voltage electrode and the ground electrode of the ignition plug so as to cause a dielectric barrier discharge to occur in the discharge region. The main fitting is fixed inside a partition wall that faces a combustion chamber of an engine, and the end portion of the high voltage electrode and the ground electrode are disposed to face each other within the combustion chamber.

Advantageous Effects of Invention

In an ignition plug according to the present, invention, a ground electrode is formed in a thin-rod shape or mesh-like shape. Thus, sufficiently strong radicals can be locally generated by a dielectric barrier discharge, ignition of fuel is enabled, an anti-inflammation effect by the ground electrode is small, and the growth of flame is hardly hindered. Furthermore, by making the thickness dimension of a second dielectric facing a discharge region uniform, the barrier discharge is spread over the surface of the second dielectric and generation of radicals is maintained, so that combustibility after the ignition is promoted. Moreover, in the case where the second dielectric covers the end portion of a high voltage electrode, by making the area of a ground electrode facing the discharge region smaller than the surface area of the second dielectric facing the discharge region, the fuel is liable to flow into the discharge region and an anti-inflammation action by the electrode is suppressed. Consequently, according to the present invention, the direct ignition of the fuel can be stably performed using the dielectric barrier discharge, and an ignition plug capable of realizing excellent, ignitability and combustibility is obtained.

In an ignition plug according to the present invention, a ground electrode is formed in a thin-rod shape or mesh-like shape. Thus, sufficiently strong radicals can be locally generated by a dielectric barrier discharge, the ignition of fuel is enabled, an anti-inflammation effect by the ground electrode is small, and the growth of a flame is hardly hindered. Furthermore, by making the thickness dimension of a second dielectric facing a discharge region uniform, a barrier discharge is spread over the surface of the second dielectric and generation of radicals is maintained, so that combustibility after ignition is promoted. Moreover, a distance G2 of a gap between the first dielectric covering the peripheral surface of the high voltage electrode and the main fitting is set to be equal to or smaller than 0.3 mm, and thus a discharge occurring between the first dielectric and the main fitting can be suppressed and electric power loss by the discharge caused in the gap is suppressed. Consequently, according to the present invention, the direct ignition of the fuel can be stably performed using the dielectric barrier discharge, and an ignition plug capable of realizing excellent ignitability and combustibility is obtained.

Furthermore, in an ignition plug according to the present invention, a ground electrode is formed, in a thin-rod shape or mesh-like shape. Thus, sufficiently strong radicals can be locally generated by a dielectric barrier discharge and ignition of fuel is enabled, an anti-inflammation effect by the ground electrode is small, and the growth of a flame is hardly hindered. Furthermore, a third protrusion having a pointed end portion is provided on a second dielectric at a location facing a discharge region, and thus the effect of decreasing a discharge initiation voltage is obtained. Consequently, according to the present invention, the direct ignition of the fuel can be stably performed using the dielectric barrier discharge, and an ignition plug capable of realizing excellent ignitability and combustibility is obtained.

Furthermore, in an ignition system according to the present invention, because an end portion of a high voltage electrode of an ignition plug and a ground electrode are disposed to face each other within a combustion chamber, a fuel gas introduced into a combustion chamber is liable to flow into an discharge region, and simultaneously with the occurrence of a dielectric barrier discharge, radicals can react with fuel so as to ignite the fuel. Consequently, according to the present invention, the direct ignition of the fuel can be stably performed using a barrier discharge, and an ignition system capable of realizing excellent ignitability and combustibility can be obtained.

An object, a feature, a standpoint and an effect other than those described above are probably apparent from the following detailed description of the present invention, which is provided with reference to the drawings.

BRIEF DESCRIPTION OF DRAWINGS

FIGS. 6A and 5B illustrate a cross-sectional view and a bottom view of the ignition plug according to embodiment 2 of the present invention.

FIG. 18 is a partly enlarged cross-sectional view illustrating the ignition plug according to embodiment 3 of the present invention.

FIG. 19 is a partly enlarged cross-sectional view illustrating a sample of an ignition plug according to embodiment 4 of the present invention.

FIG. 20 is a view illustrating a result of a combustion evaluation test of the ignition plug according to embodiment 4 of the present invention.

FIG. 21 is a view illustrating a result of a voltage-withstanding test of the ignition plug according to embodiment 4 of the present invention.

FIG. 22 is a view illustrating the result of the combustion evaluation test of the ignition plug according to embodiment 4 of the present invention.

FIG. 23A and FIG. 23B illustrate views for describing areas S1 and S2 in the ignition plug according to embodiment 4 of the present invention.

FIG. 24 is a view illustrating the result of the combustion evaluation test of the ignition plug according to embodiment 4 of the present invention.

FIG. 25 is a view for describing a ground electrode of the ignition plug according to embodiment 4 of the present invention.

FIG. 26 is a view illustrating the result of the combustion evaluation test of the ignition plug according to embodiment 4 of the present invention.

FIG. 27 is a diagram illustrating the result of the combustion evaluation test of the ignition plug according to embodiment 4 of the present invention.

FIG. 28A, FIG. 28B and FIG. 28C illustrate views for describing an angle of a protrusion of the ground electrode of the ignition plug according to embodiment 4 of the present invention.

FIG. 29 is a view illustrating the result of the combustion evaluation test of the ignition plug according to embodiment 4 of the present invention.

FIG. 30A and FIG. 30B illustrate a cross-sectional view and a bottom view of an ignition plug according to embodiment 5 of the present invention.

DESCRIPTION OF EMBODIMENTS

Embodiment 1

Figure 1A:
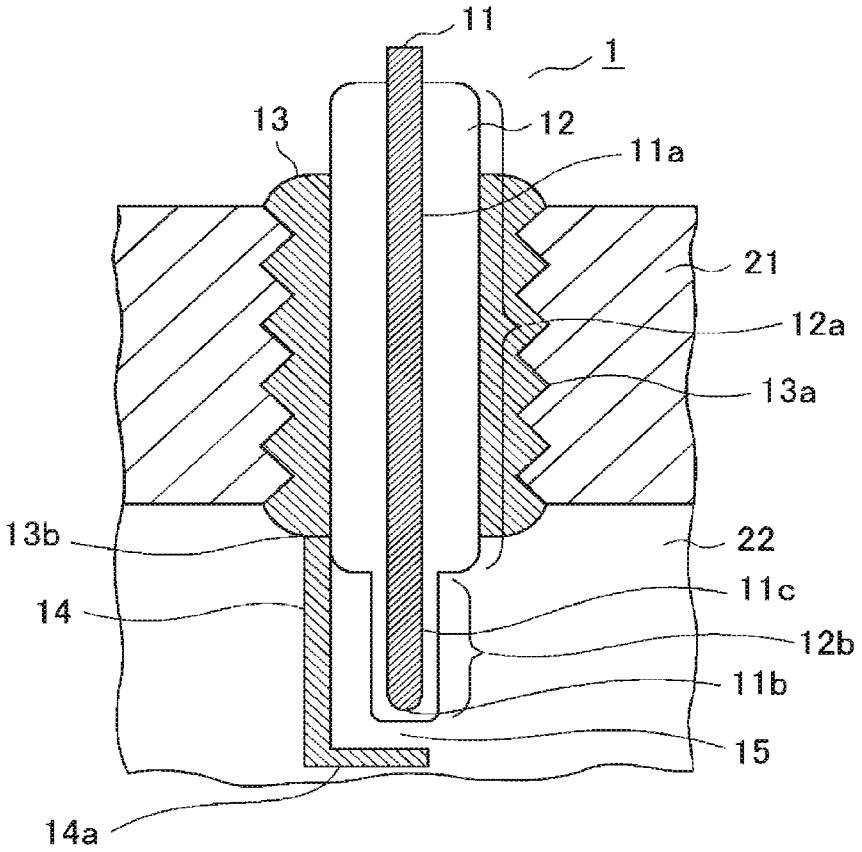
FIG. 1A and FIG. 1B illustrate a cross-sectional view and a bottom view of an ignition plug according to embodiment 1 of the present invention.
Figure 1B:
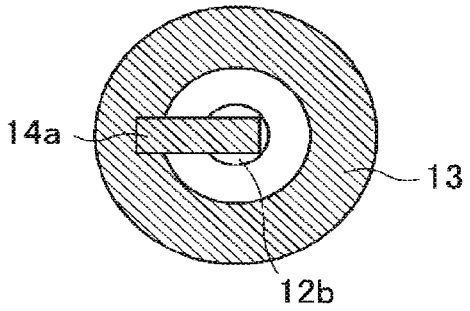

Hereinafter, an ignition plug according to embodiment 1 of the present invention and an ignition system including the same will be described with reference to the drawings. FIGS. 1A and 1B illustrate a cross-sectional view and a bottom view of the ignition plug according to embodiment 1. As illustrated in FIGS. 1A and 1B, an ignition plug 1 according to embodiment 1 includes a rod-shaped high voltage electrode 11, a first dielectric 12*a* that covers the peripheral surface 11*a* of the high voltage electrode 11, a cylindrical main fitting 13, and a rod-shaped ground electrode 14.

The main fitting 13 that is a case of the ignition plug 1 has a threaded portion 13*a* in the peripheral surface thereof, and is fixed inside a partition wall 21 that faces a combustion chamber 22 of an engine. The rod-shaped, ground electrode 14 is connected to one end surface 13*b* of the main fitting 13. The main fitting 13 and the ground electrode 14 have a ground electric potential which is the same as that of the engine. Furthermore, the peripheral surface 11*a* of the rod-shaped high voltage electrode 11, which is covered with the first dielectric 12*a*, is held in the main fitting 13, and one end portion 11*c* is exposed from the end surface 13*b* side of the main fitting 13. A distance G2 (see FIG. 19) of a gap between the first dielectric 12*a*, which covers the peripheral surface 11*a* of the high voltage electrode 11, and the main fitting 13 is set to be equal to or smaller than 0.3 mm. Accordingly, a discharge that occurs in the gap between the first dielectric 12*a* and the main fitting 13 can be suppressed, and electric power loss due to the discharge that occurs in the gap is suppressed.

Any one of the end portion 11*c* of the high voltage electrode 11 and the ground electrode 14 is covered with a second dielectric 12*b* that has a smaller thickness dimension than that of the first dielectric 12*a*, and the end portion 11*c* of the high voltage electrode 11 and the ground electrode 14 are disposed to face each other with the discharge region 15, which faces the second dielectric 12*b*, interposed therebetween. In the example illustrated in FIG. 1A, the high voltage electrode 11 is a dielectric electrode, the peripheral surface 11*a* and the end portion 11*c* of which are covered with a dielectric 12 that includes the first dielectric 12*a* and the second dielectric 12*b*. Furthermore, the thickness dimension of the second dielectric 12*b* facing the discharge region 15 is uniform. In the following description, an electrode covered with the second dielectric 12*b* will be referred to as a dielectric electrode.

The ground electrode 14 has a bent portion 14*a* formed by bending an end portion of the ground electrode 14 toward the high voltage electrode 11. The bent portion 14*a* and a tip end 11*b* of the high voltage electrode 11 are arranged to face each other so as to form the discharge region 15. Furthermore, because the ground electrode 14 is configured with a thin-rod-shaped metal, sufficiently strong radicals are locally generated due to a dielectric barrier discharge (hereinafter, simply described as a barrier discharge).

Moreover, in order to enable direct ignition by the barrier discharge, a fuel gas needs to flow into the discharge region 15. However, the discharge region 15 that is formed in the tip end of the ignition plug 1 protrudes into the combustion chamber 22 and is exposed to a flow of the fuel gas. Furthermore, in the case where the second dielectric 12*b* covers the end portion 11*c* of the high voltage electrode 11, the area of the ground electrode 14 facing the discharge region 15 is smaller than the surface area of the second dielectric 12*b* facing the discharge region 15. For this reason, the fuel introduced into the combustion chamber 22 easily flows into the discharge region 15, and is directly ignited by sufficiently strong radicals produced by the barrier discharge.

The shapes of and an arrangement of the high voltage electrode 11, the ground electrode 14, and the second dielectric 12*b* are not limited to those described herein, and various modifications can be made. For example, the ground electrode 14 may not have the bent portion 14*a*. Various modifications to embodiments 2 and 3 will be described.

Figure 2:
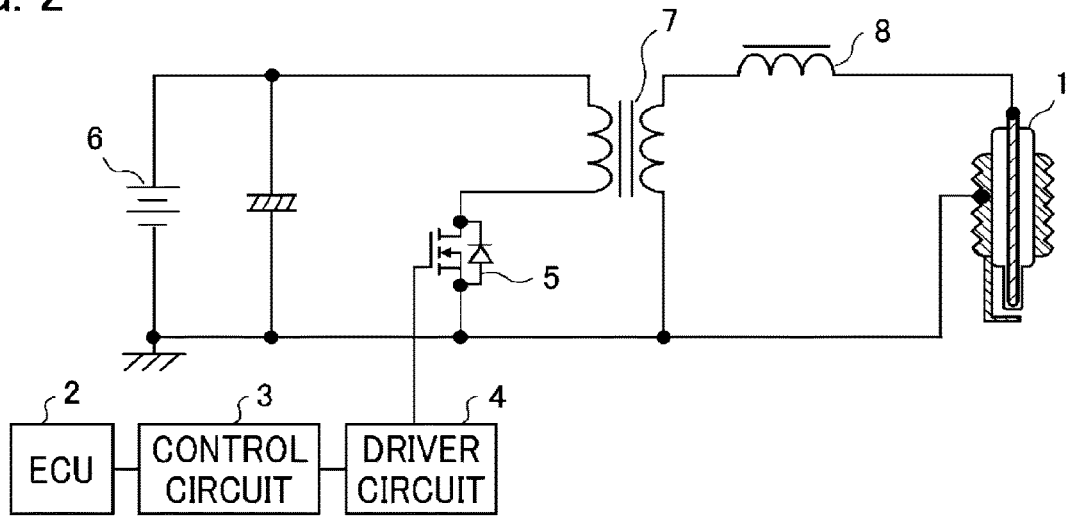
FIG. 2 is a view illustrating a drive circuit of an ignition system according to embodiment 1 of the present invention.
Figure 3A:
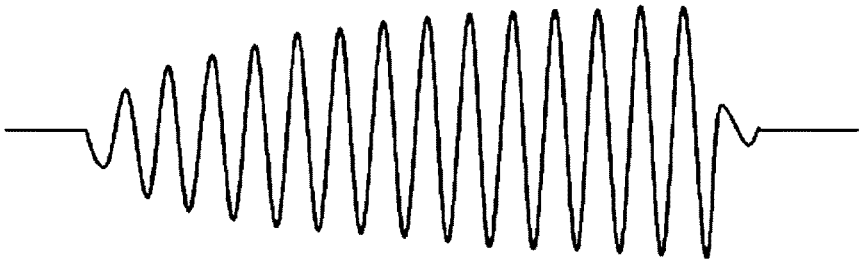
FIG. 3A and FIG. 3B illustrate waveforms of an ignition signal and an alternating current high voltage in the ignition system according to embodiment 1 of the present invention.
Figure 3B:
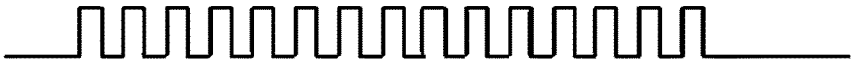

An ignition system according to embodiment 1 includes the ignition plug 1 and an alternating current voltage application unit that applies an alternating current high voltage between the high voltage electrode 11 and the ground electrode 14 of the ignition plug 1 so as to cause the barrier discharge in the discharge region 15. FIG. 2 illustrates an example of a drive circuit that is the alternating current voltage application unit. FIGS. 3A and 3B illustrate waveforms of an ignition signal and an alternating current high voltage in the case where the drive circuit illustrated in FIG. 2 is used.

In FIG. 2, a control signal 3, which has acquired an engine ignition signal output from an Engine Control Unit (ECU) 2, generates a drive signal required for ignition. In response to the drive signal, a driver circuit 4 outputs a switching waveform as illustrated in FIG. 3B, and turns on or off a switching element 5. By turning on or off the switching element 5, an electric current from a DC power source 6 is converted into an alternating current, and the resulting alternating current is boosted by a transformer 7. A resonance coil 8 is provided on the secondary side of the transformer 7. The capacitance of the resonance coil 8 and the capacitance of the ignition plug 1 resonate such that an alternating current high voltage is applied to a high voltage terminal portion of the ignition plug 1.

When switching is repeated at a frequency that is close to the resonance frequency of the drive circuit, a voltage across the opposite ends of the secondary side ignition plug 1 increases by the resonance. As illustrated in FIG. 3A, a voltage waveform gradually increases while fluctuating with an alternating current and reaches a steady-state value at a certain point. When a boosting ratio (a Q value) by resonance is large, many periods are required until the voltage waveform reaches the steady-state value. When an application period of successive pulses (the number of times of switching) is too short, the ignition cannot be caused reliably, and when the application period is too long, power loss is caused.

Figure 4:
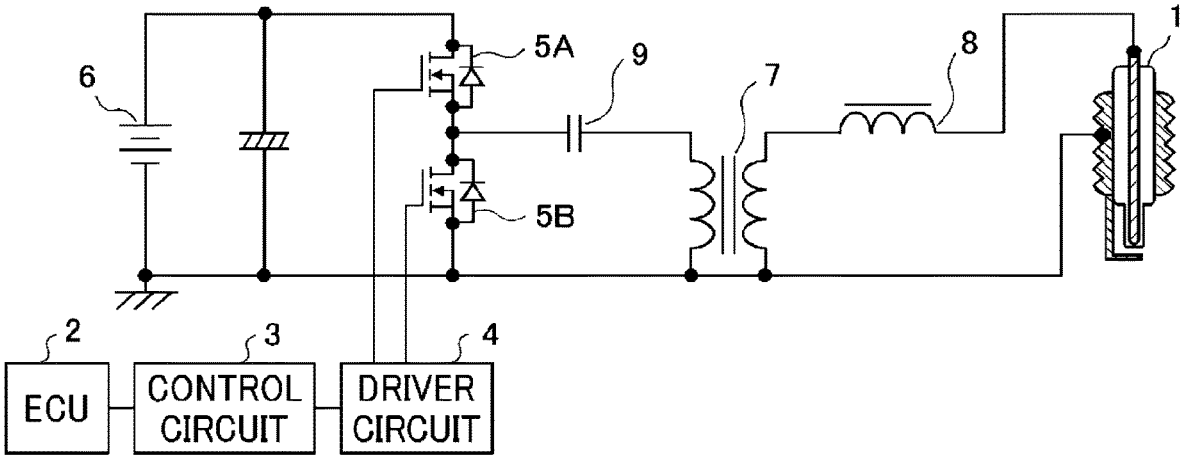
FIG. 4 is a view illustrating another drive circuit of the ignition system according to embodiment 1 of the present invention.

The drive circuit illustrated in FIG. 2 is a very simple circuit that includes a single switching element 5, but a drive circuit having, for example, a half bridge configuration, as illustrated in FIG. 4, may be used. In the example illustrated in FIG. 4, the current from the DC power source 6 is converted into an alternating current by a half bridge inverter including two switching elements 5A and 5B. The converted alternating current is applied to the primary side of the transformer 7 through a biased-magnetization prevention capacitor 9 for preventing biased magnetization of a transformer and is boosted by the transformer 7. The boosted alternating current is output to the secondary side. Thereafter, as in the example in FIG. 2, the alternating current high voltage is further boosted by the resonance coil 8, and the alternating current high voltage is applied to the high voltage terminal portion of the ignition plug 1. In addition, a full bridge inverter or push pull scheme may be used as a switching circuit scheme.

As described above, according to the ignition plug 1 and the ignition system according to embodiment 1, when the ground electrode 14 is formed in a thin-rod shape, sufficiently strong radicals can be locally generated by the barrier discharge. Furthermore, because the end portion 11*c* of the high voltage electrode 11 and the ground electrode 14 are arranged to face each other within the combustion chamber 22, the fuel gas introduced into the combustion chamber 22 tends to flow into the discharge region 15 and is likely to be ignited by the radicals generated due to the discharge. That is, simultaneously with the occurrence of the barrier discharge, the radicals can react with the fuel so as to ignite the fuel.

Furthermore, because the barrier discharge is spread over the surface of the dielectric electrode and the generation of radicals is maintained, the combustibility after ignition is promoted. Moreover, because the ground electrode 14 has a thin-rod shape, an anti-inflammation effect by the electrode is small and it is difficult to hinder the growth of flame. From these, according to embodiment 1, the direct ignition of fuel can be stably performed using the barrier discharge, and the ignition plug 1 capable of realizing excellent ignitibility and combustibility and the ignition system including the same can be obtained.

Embodiment 2

In embodiment 2 of the present invention, a basic modification of the ignition plug 1 (FIGS. 1A and 1B) according embodiment 1 described above will be described with reference to FIGS. 5A and 5B to FIGS. 7A and 7B. The same or corresponding portions in respective drawings will be denoted by the same reference numerals, and descriptions thereof will be omitted.

Figure 5A:
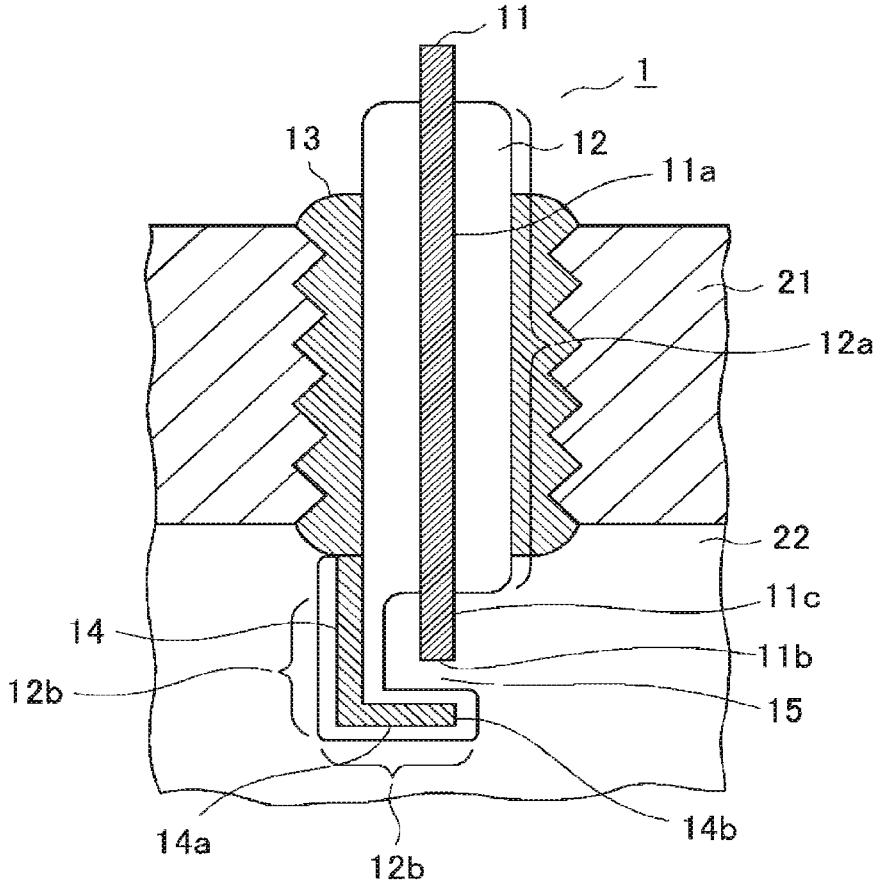
FIG. 5A and FIG. 5B illustrate a cross-sectional view and a bottom view diagram of an ignition plug according to embodiment 2 of the present invention.
Figure 5B:
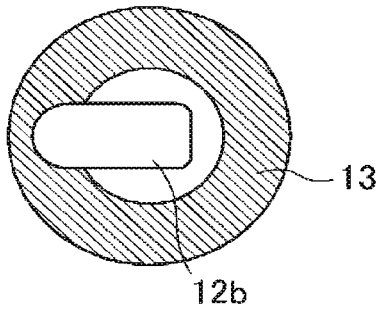
Figure 6A:
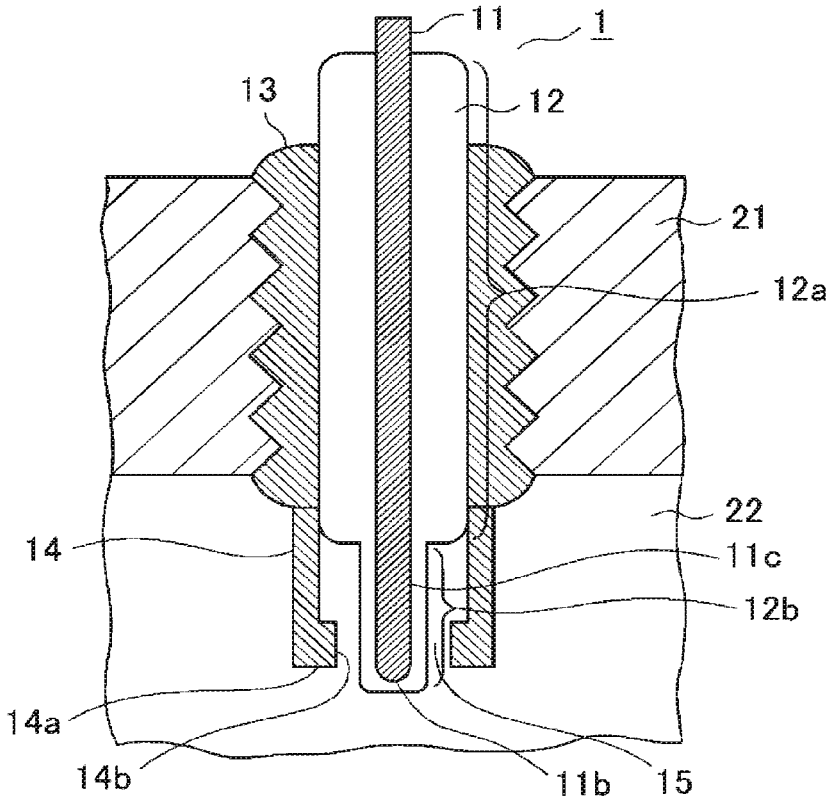
Figure 6B:
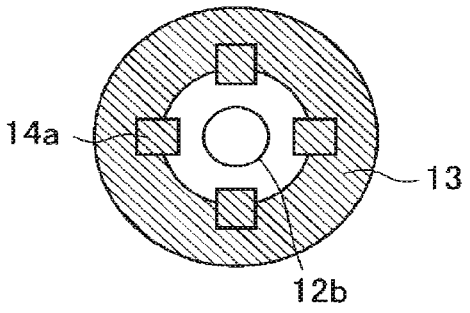

In order to generate the barrier discharge, the second dielectric 12*b* needs to be interposed between the high voltage electrode 11 and the ground electrode 14. The second dielectric 12*b* may be provided on any electrodes. In embodiment 1 described above, the high voltage electrode 11 is configured to be covered with the second dielectric 12*b*, but as illustrated in FIGS. 5A and 5B, the ground electrode 14 may be covered with the second dielectric 12*b*, thereby being configured as a dielectric electrode. In that case, the end portion 11*c* of the high voltage electrode 11 is exposed from the dielectric 12.

Furthermore, in embodiment 1 described above, the example in which one rod-shaped ground electrode 14 is disposed is illustrated, but a plurality of ground electrodes 14 may be disposed. In the example illustrated in FIGS. 6A and 6B, four thin-rod-shaped ground electrodes 14 are provided, and the end of each ground electrode 14 has a bent portion 14*a* bent toward the high voltage electrode 11. Furthermore, a tip end portion 14*b* of each ground electrode 14 faces the end portion 11*c* above the tip portion 11*b* of the high voltage electrode 11 so as to form the discharge region 15.

In the case where a plurality of ground electrodes 14 are provided, the ground electrode may cause barrier discharges in parallel with each other. That is, since the discharges can be simultaneously generated at a plurality of locations and combustion can be initiated at the plurality of locations, the ignition and combustion stability can be further improved. In the example illustrated in FIGS. 6A and 6B, because the ground electrode 14 is a thin-rod-shaped metal, and the barrier discharge is generated at the tip portion 14*b* thereof, the sufficiently strong radicals are locally generated.

Furthermore, a tip end of the ignition plug 1, which forms the discharge region 15, protrudes into the combustion chamber 22, and is exposed to the flow of the fuel gas. For this reason, the fuel gas flows into the discharge region 15 through a gap between the four thin-rod-shaped ground electrodes 14, and is directly ignited by the sufficiently strong radicals locally generated by the barrier discharge.

In order to ensure that the fuel introduced into the combustion chamber 22 flows into the discharge region 15, the area of each ground electrode 14 facing the discharge region 15 needs to be smaller than that of the dielectric electrode facing the discharge region 15. Definitions of the areas of the ground electrodes 14 and the area of the dielectric electrode, which face the discharge region 15, will be described with reference to FIGS. 7A and 7B.

Figure 7A:
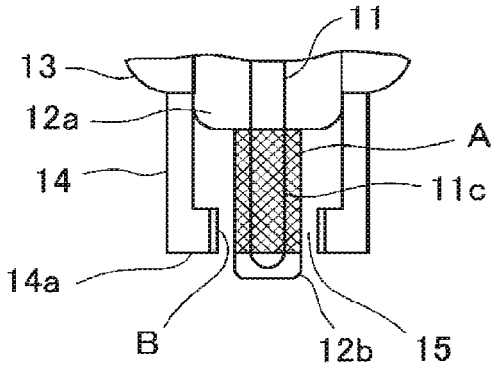
FIG. 7A and FIG. 7B illustrate views for describing the areas of a ground electrode and a dielectric electrode facing a discharge region in the ignition plug according to embodiment 2 of the present invention.
Figure 7B:
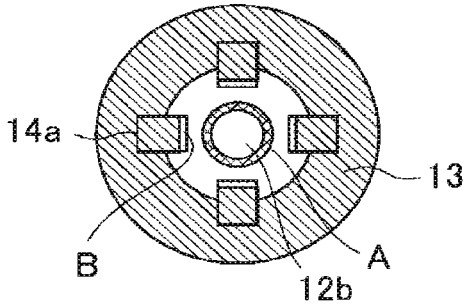

In FIGS. 7A and 7B, a hatched portion A indicates the area of the dielectric electrode facing the discharge region 15, and hatched portions B indicate the areas of the ground electrode 14 facing the discharge region 15. The areas of the electrodes refer to areas into which an electric current by the barrier discharge flows. In each ground electrode 14 that is a metal electrode, the rear side that does not face the dielectric electrode is not included in the area of the electrode. In the case where the ground electrode 14 is a metal electrode, in a portion at the shortest distance to the discharge region 15 (the portion is referred to as a discharge gap), the area of a portion facing the dielectric electrode is defined as the area of the ground electrode 14 facing the discharge region 15.

On the other hand, in the case of the dielectric electrode, as a feature of the barrier discharge, the discharge tends to be spread over the entire wide electrode area. However, the discharge is spread over a portion of the second dielectric 12*b*, which has a uniform thickness dimension, but is not spread over a portion that has a large thickness dimension. Therefore, a portion of the hatched portion A is defined as a surface area of the dielectric electrode facing the discharge region 15.

The barrier discharge is characterized in that the discharge first occurs at the shortest distance between the electrodes, that is, at a location in the discharge gap, but thereafter, the discharge occurs while avoiding a location on a surface of the second dielectric 12*b*, at which the discharge occurred once. For this reason, the discharge occurs along the surface of the second dielectric 12*b*. More precisely, the point at which discharge first occurs is not limited to a location that is at the shortest distance between the electrodes, and the discharge occurs starting from a location at which the intensity of electric field is highest.

In a spark plug in the related art, because a spark discharge (an arc discharge) is generated, a "gas temperature" becomes very high, and an electrode is consumed due to the occurrence of the discharge. Therefore, in order to increase the life of the ignition plug, it is necessary to thickly form the tip end portion of the electrode to a certain degree. On the other hand, because the barrier discharge is not a spark discharge (arch discharge), the barrier discharge is characterized in that the electrode is not consumed, and a sufficiently long life is obtained even if the ground electrode 14 is formed thin.

Moreover, by forming the ground electrode 14 thin, because the fuel tends to flow into the discharge region 15 and the anti-inflammation operation by the electrode is hindered, it is also desirable to form the ground electrode 14 as thin as possible in a range where a mechanical strength can be retained and where overheating of the electrode due to the combustion is can be prevented.

In the ignition plug 1 according to embodiment 2, the same effect as that in embodiment 1 described above can be obtained. Further, by providing a plurality of thin-rod-shaped ground electrodes 14, the barrier discharges can be simultaneously generated at a plurality of locations. Furthermore, because the sufficiently strong radicals are generated by the barrier discharges, the ignition and combustion stability can be further improved.

Embodiment 3

In embodiment 3 of the present invention, as a modification of the ignition plug 1 (FIGS. 1A and 1B) according to embodiment 1 descried above, an example in which a protrusion having a pointed end portion or a small metal piece is provided on a surface of the high voltage electrode 11, the second dielectric 12*b*, or the ground electrode 14, which faces the discharge region 15, will be described with reference to FIGS. 8A and 8B to FIG. 18. In respective drawings, the same or corresponding portions in the drawings will be denoted by the same reference numerals, and descriptions thereof will be omitted.

Figure 8A:
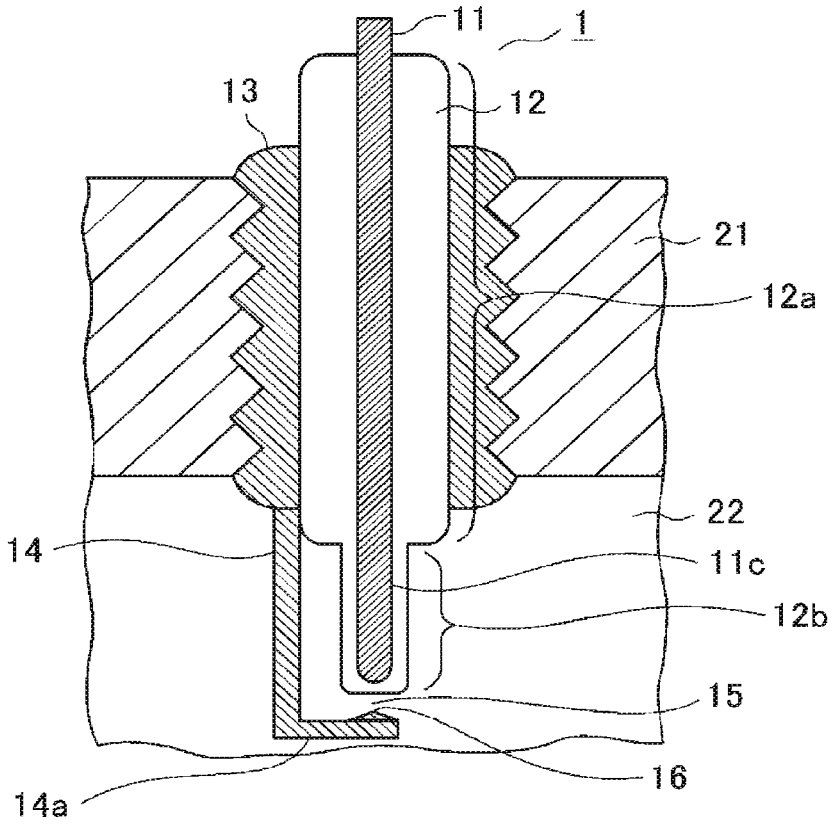
FIG. 8A and FIG. 8B illustrate a cross-sectional view and a bottom view of an ignition plug according to embodiment 3 of the present invention.
Figure 8B:
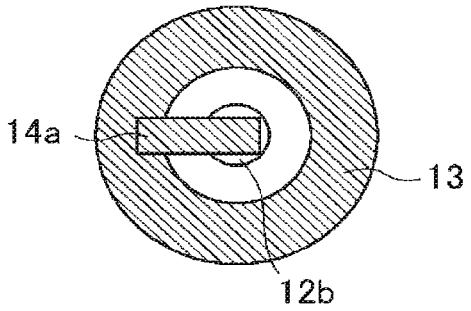

In the example illustrated in FIGS. 8A and 8B, the ground electrode 14 is a single metal electrode, and includes a first protrusion 16 having a pointed end portion protruding into the discharge region 15 at a location on the bent portion 14*a* of the ground electrode 14, which faces the discharge region 15. Furthermore, in the example illustrated in FIGS. 9A and 9B, the ground electrodes 14 are four thin-rod-shaped metal electrodes, and each of the electrodes 14 includes a first protrusion 16 on the tip end portion 14*b* of the bent portion 14*a*.

Figure 10A:
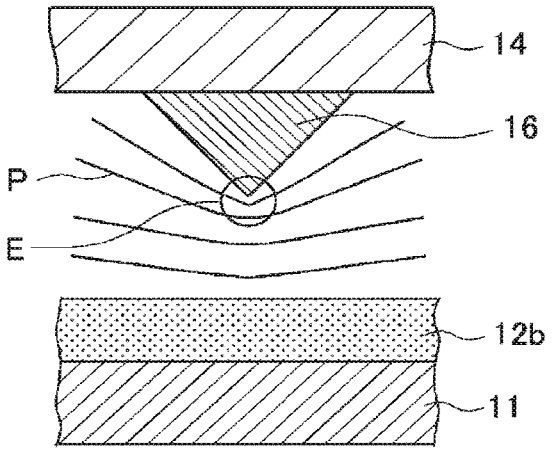
FIG. 10A and FIG. 10B illustrate views for describing electric field concentration due to a protrusion of a ground electrode in the ignition plug according to embodiment 3 of the present invention.
Figure 10B:
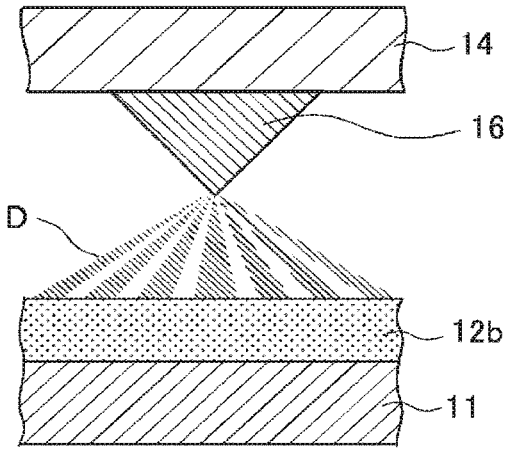

Concentration of an electric field when the ground electrodes 14 having the first protrusions 16 are disposed to face the dielectric electrode in the ignition plug 1 according to embodiment 3 will be described with reference to FIGS. 10A and 10B. In FIGS. 10A and 10B, P, E, and D indicate an equipotential plane, the concentration of electric field, and a barrier discharge, respectively. In the case where a first protrusion 16 having a pointed end portion is provided on the ground electrode 14 that is a metal electrode, and is disposed to face the dielectric electrode, the electric field is concentrated at a pointed end portion of the first protrusion 16 of the ground electrode 14, as illustrated in FIG. 10A. In the case where the barrier discharge is generated between the electrodes, the discharge is generated in such a manner that the discharge is spread from the pointed end portion of the first protrusion 16 of the ground electrode 14 over the surface of the second dielectric 12*b*, as illustrated in FIG. 10B.

As a characteristic of the barrier discharge, a thin streamer-shaped discharge is generated in a very short time and intermittently and is spread over the surface of the dielectric electrode. In the case of a normal barrier discharge generated between the electrodes that face each other in a fixed, space, because the uniform discharge is generated over a wide area, radicals are efficiently generated, the generated radicals are distributed over a wide area, and the gas is maintained in a low temperature state. In order to perform the stable ignition, since the density of the radicals and the gas temperature need to be high to a certain degree. For this reason, the normal barrier discharge is unsuitable for direct ignition.

Figure 9A:
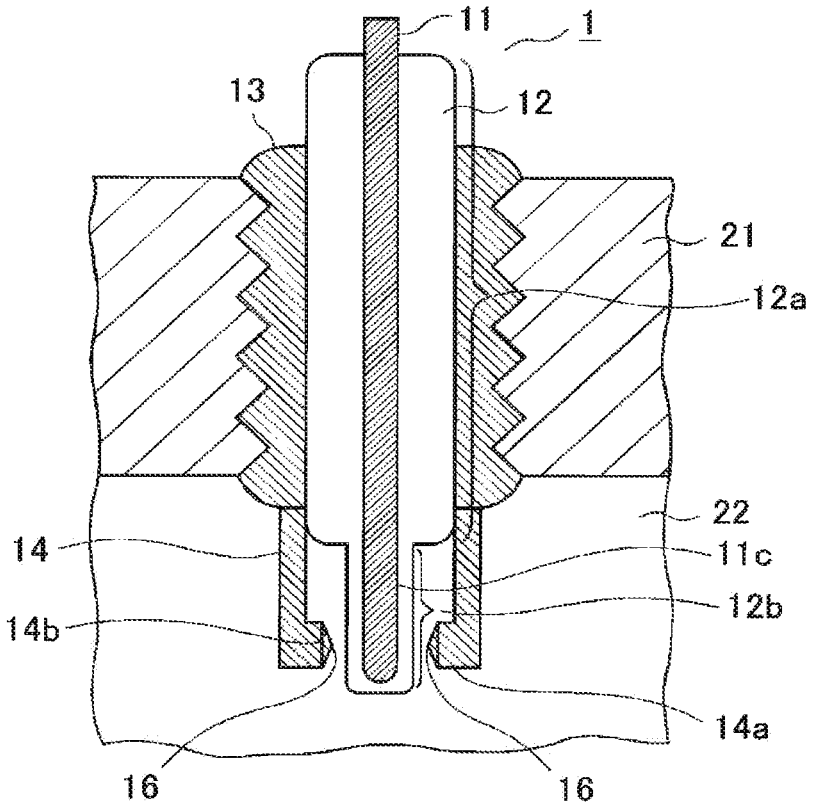
FIG. 9A and FIG. 9B illustrate a cross-sectional view and a bottom view of the ignition plug according to embodiment 3 of the present invention.
Figure 9B:
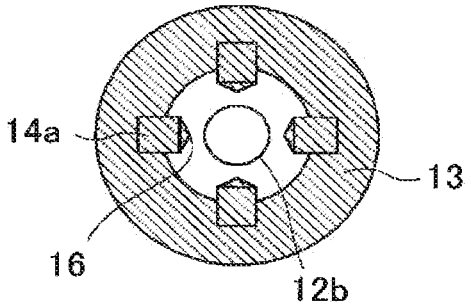

In contrast, in configurations illustrated in FIGS. 8A and 8B and FIGS. 9A and 9B, since the discharge is concentrated at the pointed end portion of the first protrusion 16 of the ground electrode 14 and a portion at which the density of the radicals and the gas temperature are locally high occurs, stable ignition can be realized. Furthermore, as illustrated in FIGS. 9A and 9B, by setting the number of the ground electrodes 14 each having the first protrusion 16 to be plural, the number of ignition-triggered portions increases, and the more stable discharge is enabled. Moreover, by providing the first protrusion 16 on the tip end portion 14*b* of the ground electrode 14, causing the ignition by concentrating the discharge on this portion, it is possible to cause the ignition to be initiated near the center of the combustion chamber 22, and to suppress the anti-inflammation effect caused by the root portion of the ignition plug 1.

Figure 11A:
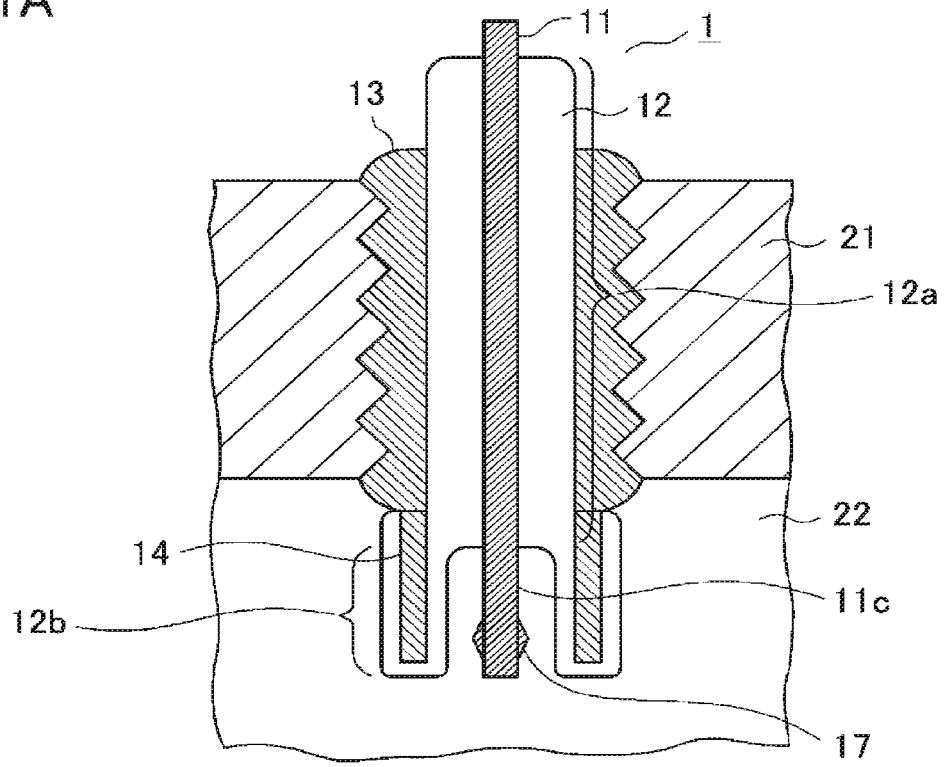
FIG. 11A and FIG. 11B illustrate a cross-sectional view and a bottom view of the ignition plug according to embodiment 3 of the present invention.
Figure 11B:
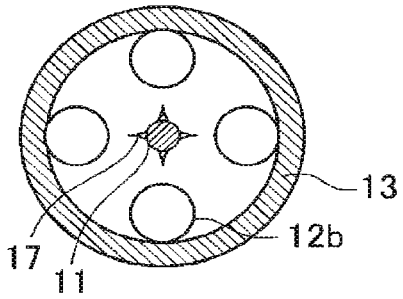
Figure 12A:
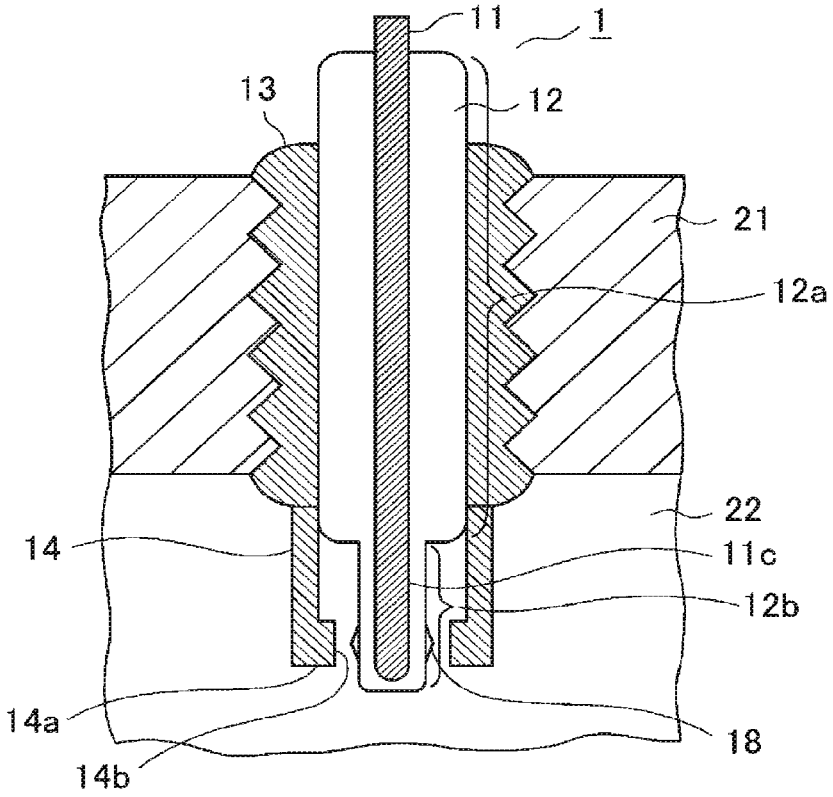
FIG. 12A and FIG. 12B illustrate a cross-sectional view and a bottom view of the ignition plug according to embodiment 3 of the present invention.
Figure 12B:
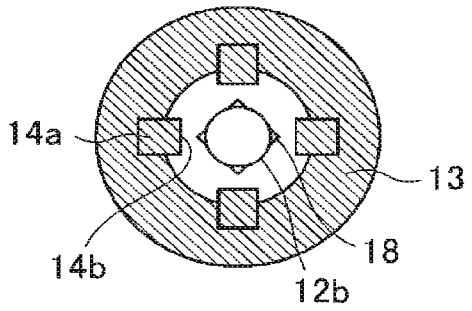

Furthermore, in the example illustrated in FIGS. 11A and 11B, second protrusions 17 each having a pointed end portion protruding into the discharge region 15 are provided on the end portion 11*c* of the high voltage electrode 11 at the locations facing the discharge region 15. In this example, the end portion 11*c* of the high voltage electrode 11 that is a metal electrode is exposed from the dielectric 12, and four ground electrodes 14 are dielectric electrodes, each of which is covered with the second dielectric 12*b*. The end portion 11*c* of the high voltage electrode 11 has four second protrusions 17 at the positions facing the four ground electrodes 14, respectively. The example illustrated in FIGS. 11A and 11B is effective in the case where the ground electrode 14 is covered with the second dielectric 12*b*, although the structure thereof is complicated.

In addition, the first protrusions 16 and the second protrusions 17 are provided directly on metal electrodes, but third protrusions 18, each of which has a pointed end portion protruding into the discharge region 15 may be provided on the second dielectric 12*b*, which covers any one of the end portion 11*c* of the high voltage electrode 11 and the ground electrodes 14, at the locations facing the discharge region 15. In the example illustrated in FIGS. 12A and 12B, four third protrusions 18, which face four ground electrodes 14, respectively, are provided on the second dielectric 12*b* that covers the high voltage electrode 11.

Figure 13A:
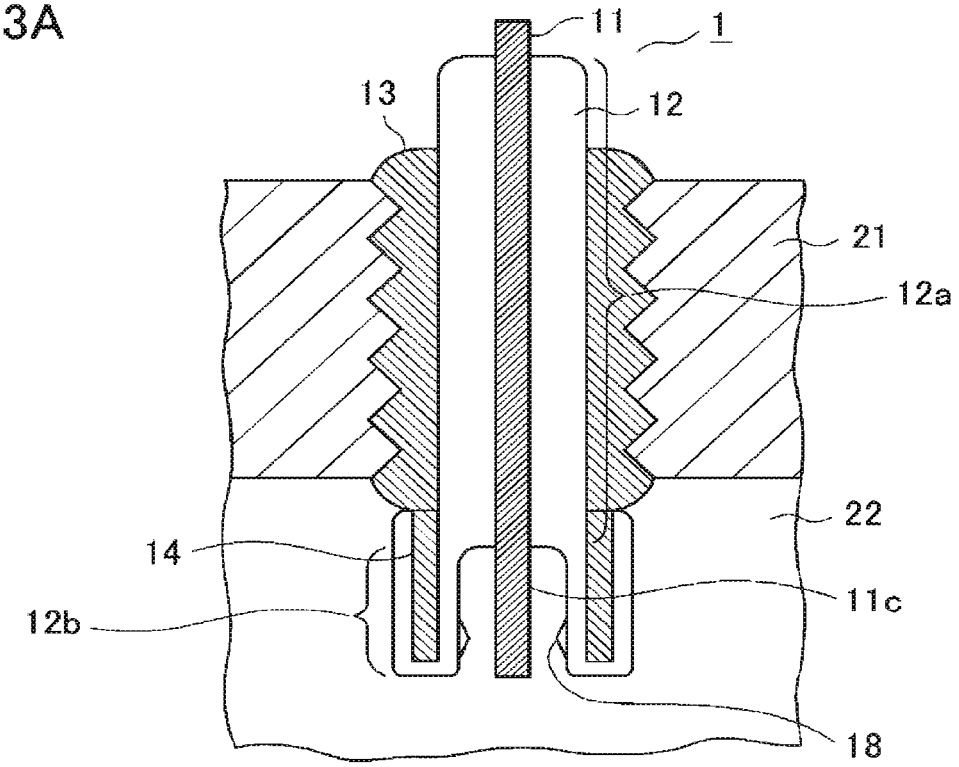
FIG. 13A and FIG. 13B illustrate a cross-sectional view and a bottom view of the ignition plug according to embodiment 3 of the present invention.
Figure 13B:
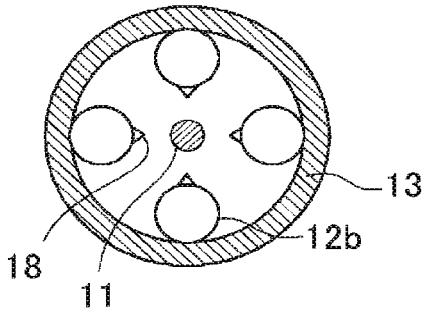
Figure 14A:
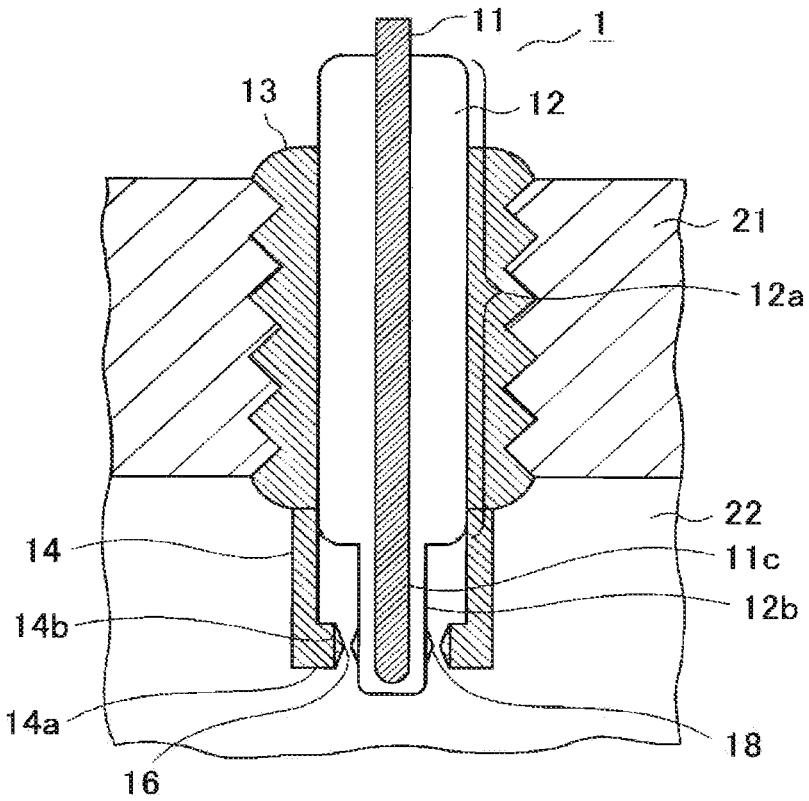
FIG. 14A and FIG. 14B illustrate a cross-sectional view and a bottom view of the ignition plug according to embodiment 3 of the present invention.
Figure 14B:
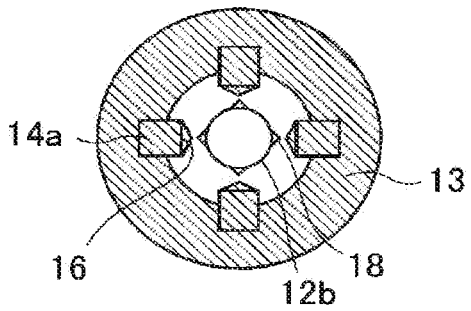

Furthermore, in the example illustrated in FIGS. 13A and 13B, each of four ground electrodes 14 is covered with the second dielectric 12*b*, and the third protrusion 18 is provided on each second dielectric 12*b*. In this example, each of the third protrusions 18 has a pointed end portion that protrudes into the discharge region 15, and a distance between the pointed end portion of each of the third protrusions 18 and the electrode facing the pointed end portion is the shortest distance between both electrodes in the discharge region 15, that is, the discharge gap.

The method of generating a discharge in the case where the first protrusions 16 or the second protrusions 17 are provided directly to the metal electrodes and the method of generating a discharge in the case where the third protrusions 18 are provided on the surface of the dielectric electrodes are different from each other. Even when the third protrusion 18 is provided on the surface of the second dielectric 12*b*, because the concentration of the electric field as illustrated in FIGS. 10A and 10B is generated, the discharge is generated from this portion as an initiation point.

While the discharge repeatedly occurs in the pointed end portion thereof in the case of the first protrusion 16 or the second protrusion 17 on the metal electrode, the discharge cannot occur successively in such a portion in the case of the third protrusion 18 on the second dielectric 12*b*, and thus the discharge is spread to a certain degree. For this reason, in the case where the third protrusion 18 is provided on the second dielectric 12*b*, the effect of decreasing a discharge initiation voltage is obtained, but the concentration of the discharge becomes weak. Therefore, a suitable configuration may be selected depending on the degree of concentration of the required discharge.

In FIGS. 8A and 8B to FIGS. 13A and 13B, the example in which any one of a first or second protrusion 16 or 17 provided on the metal electrode and a third protrusion 18 provided on the second dielectric 12*b* is provided is illustrated, but that both of these may be provided. In the example illustrated in FIGS. 14A and 14B, the first protrusion 16 is provided on the tip end portion 14*b* of each of the four ground electrodes 14, and four third protrusions 18 are provided on the dielectric electrode. In this case, because the discharge is caused concentratedly at the pointed end portion of each of the first protrusions 16 and the third protrusions 18, the first protrusions 16 and the third protrusions 18 are disposed to face each other in such a manner that a distance interconnecting respective pointed end portions becomes the shortest distance in the discharge region 15, that is, the electric charge gap.

Figure 15A:
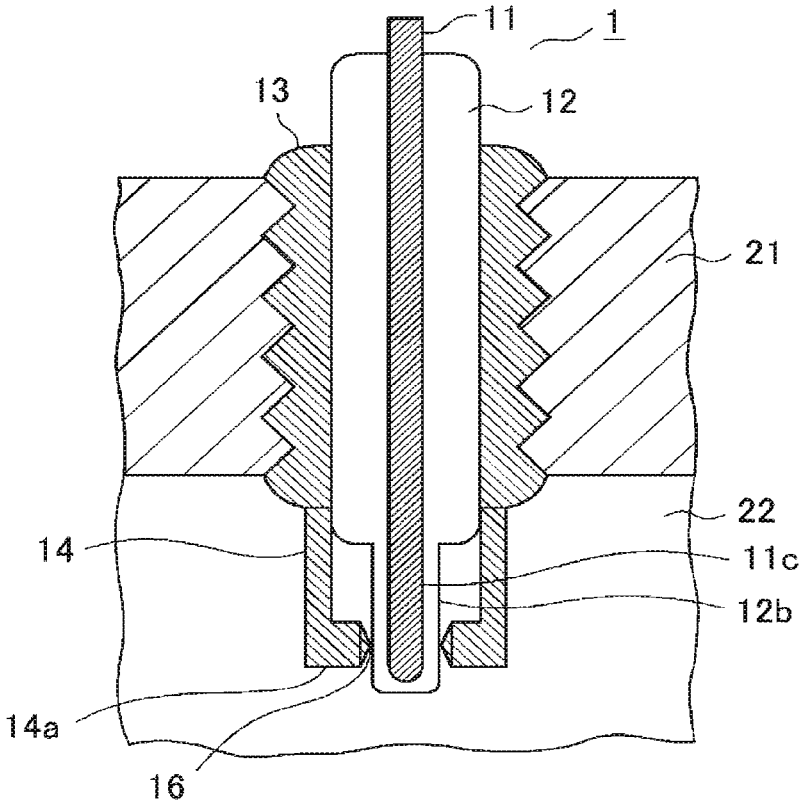
FIG. 15A and FIG. 15B illustrate a cross-sectional view and a bottom view of the ignition plug according to the embodiment 3 of the present invention.
Figure 15B:
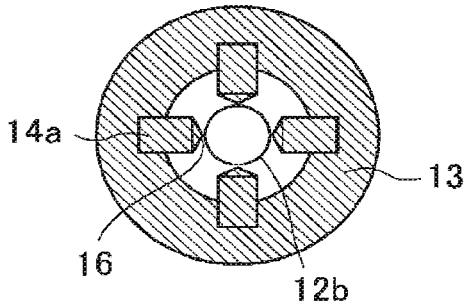

Furthermore, the example illustrated in FIGS. 15A and 15B is a similar to that in FIGS. 9A and 9B in configuration, but has a configuration in which the discharge gap is almost zero 0 and the discharge is close to a corona discharge.

In this case, the discharge is spread in such a manner that the discharge is initiated from the pointed end portions of the first protrusions 16 provided on the ground electrodes 14 which are metal electrodes and creeps over the dielectric electrode.

With this configuration, an effect of decreasing a discharge voltage is obtained.

Figure 16A:
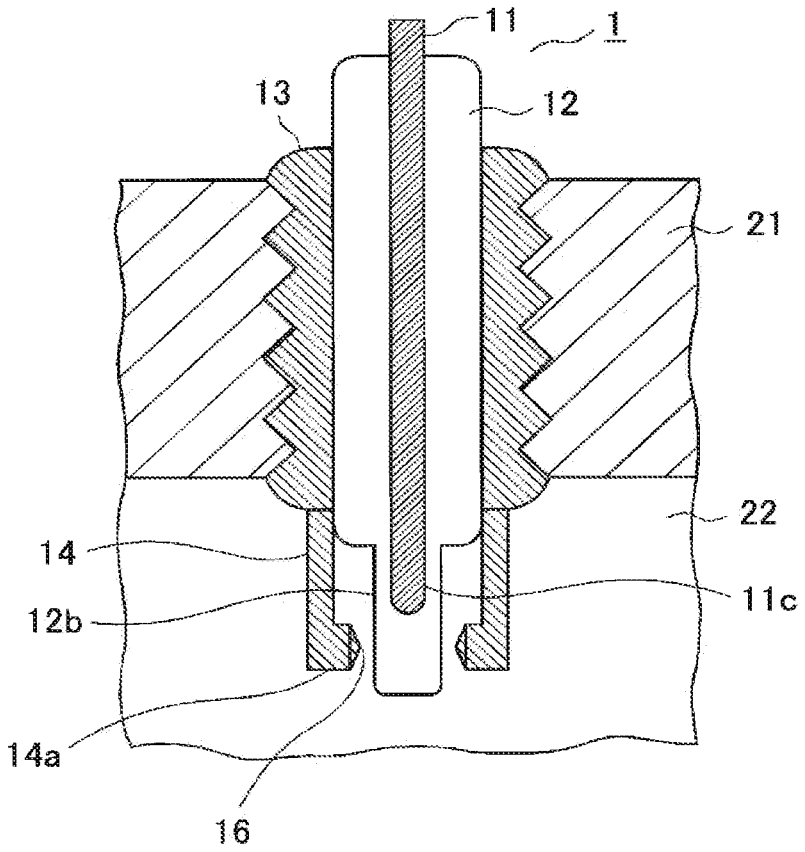
FIG. 16A and FIG. 16B illustrate a cross-sectional view and a partly enlarged cross-sectional view of the ignition plug according to embodiment 3 of the present invention.
Figure 16B:
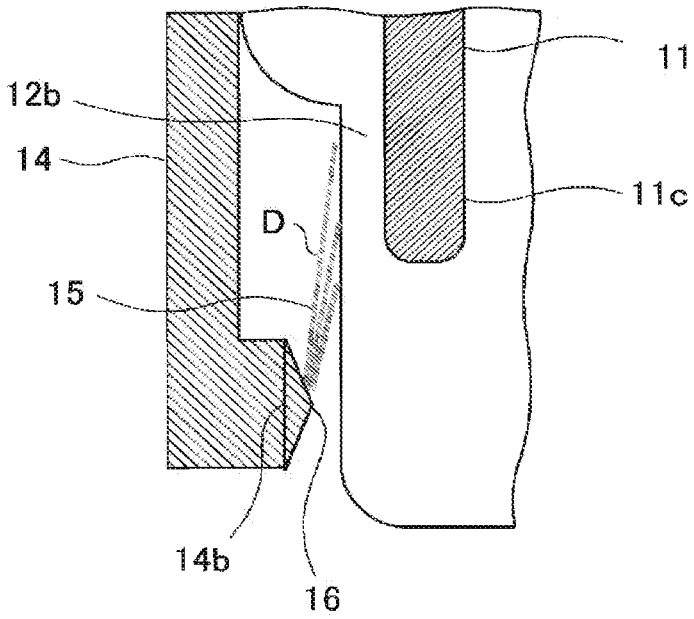

Moreover, the example illustrated in FIG. 16A has a configuration similar to that in FIGS. 9A and 9B. However, the high voltage electrode 11 covered with the second dielectric 12*b* has a length shorter than that in FIGS. 9A and 9B, and is located at a position spaced apart from the first protrusions 16 provided on the ground electrodes 14. In this case, a barrier discharge D flies a long distance as illustrated in FIG. 16B. For this reason, in contrast to the example illustrated in FIGS. 15A and 15B, the discharge voltage increases, radicals are efficiently generated, and the anti-inflammation effect by the electrodes is suppressed as well.

Figure 17A:
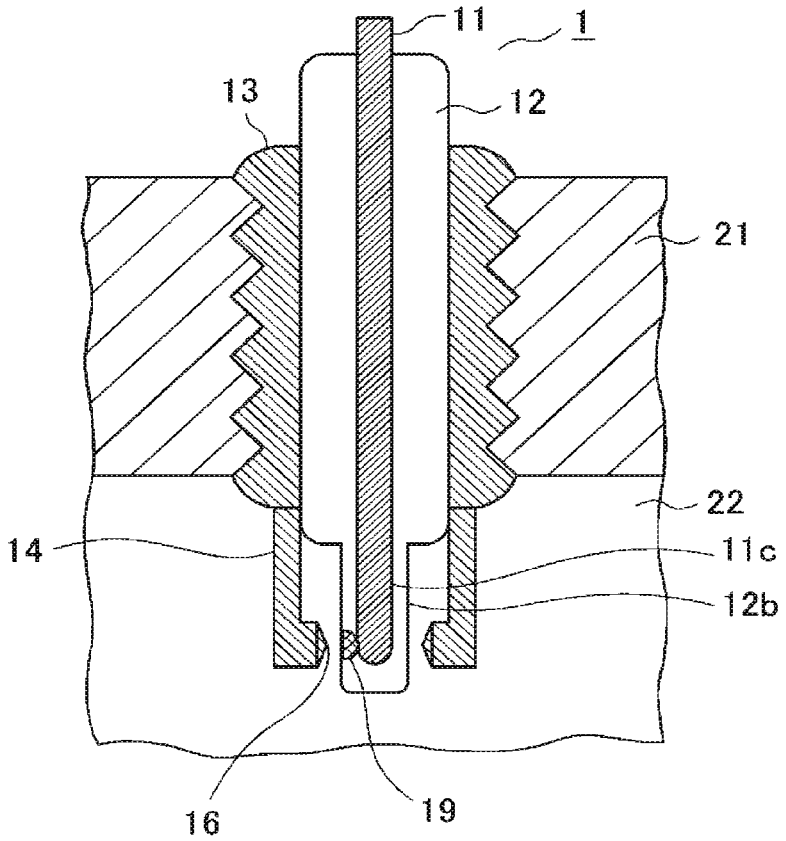
FIG. 17A and FIG. 17B illustrate a cross-sectional view and a partly enlarged cross-sectional view of the ignition plug according to embodiment 3 of the present invention.
Figure 17B:
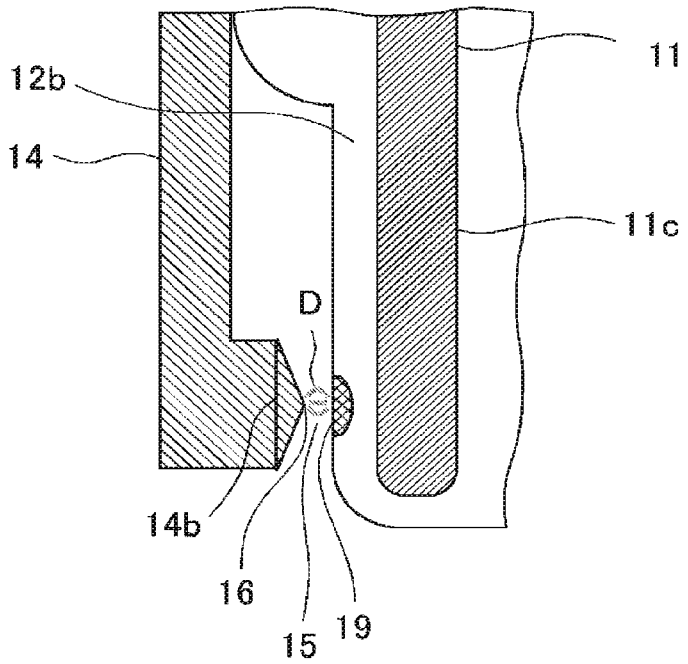

Furthermore, in the examples illustrated in FIGS. 17A and 17B and 18, a small metal piece 19 or 19*a* is provided on the second dielectric 12*b*, which covers the end portion 11*c* of the high voltage electrode 11, at a location facing the discharge region 15. In the example illustrated in FIGS. 17A and 17B, the small metal piece 19 such as a metal foil is attached to the surface of the second dielectric 12*b* that faces the first protrusion 16. In this case, as illustrated in FIG. 17B, the barrier discharge D occurs between the pointed end portion of the first protrusion 16 provided on the ground electrode 14 and the small metal piece 19 provided on the surface of the second dielectric 12*b*. The barrier discharge D typically refers to a discharge in which minute discharges occur intermittently. However, by providing the small metal piece 19, an amount of electric charge of one discharge increases and the discharge generated thereby is stronger than that generated in the case where the small metal piece 19 is not provided.

A charge amount that moves due to the barrier discharge is in proportion to the capacity of a capacitor configured by the small metal piece 19 on the second dielectric 12*b* with the dielectric layer. That is, when the small metal piece 19 increases in size, the charge amount that moves by one barrier discharge increases. By using this, it is possible to strengthen the discharge or to control the intensity of the discharge to a desired value, and more stable ignition can be performed. Furthermore, as illustrated in FIG. 18, by providing the small metal piece 19*a* having a pointed end portion, it is possible to further lower the voltage of the barrier discharge. In addition, the small metal piece 19 or 19*a* may be provided on the surface of the second dielectric 12*b* that covers the ground electrode 14.

According to embodiment 3, in addition to the effects similar to those of embodiments 1 and 2 described above, effects of improving ignition performance and decreasing the discharge voltage are obtained. Furthermore, it is possible to control the intensity of the barrier discharge, and to perform more stable ignition.

Embodiment 4

In embodiment 4 of the present invention, a sample of an ignition plug was manufactured, and a dimension and the like of respective portions thereof were examined in detail from results of a combustion evaluation test and the like. FIG. 19 is a partially-enlarged cross-sectional view illustrating a tip end portion of the sample of the ignition plug. As illustrated in FIG. 19, the peripheral surface 11*a* and the end portion 11*c* of the high voltage electrode 11 of the sample of the ignition plug are covered with the dielectric 12, and the thickness dimension of the second dielectric 12*b* facing an discharge region is uniform.

In the sample illustrated in FIG. 19, it is assumed that the thickness dimension of the second dielectric 12*b* facing the discharge region is D1, the thickness dimension of the first dielectric 12*a* covering the peripheral surface 11*a* is D2, the discharge gap, which is the shortest distance between the second dielectric 12*b* covering the end portion 11*c* of the high voltage electrode 11 and the ground electrode 14, is G1, and a gap between the first dielectric 12*a* covering the peripheral surface 11*a* of the high voltage electrode 11 within the main fitting 13 and the main fitting 13 is G2.

(1) Examination on G2 (FIG. 20)

It is desirable that the barrier discharge occurs in a G1 portion which is the discharge gap. However, the ignition plug structurally has the gap G2, which occurs between the first dielectric 12*a* and the main fitting 13. The discharge in the G2 portion is not desirable. In order to determine a value of G2 at which no discharge occurs, a combustion evaluation test was performed using samples which were manufactured to have G2 in a range of 1 mm to 1.5 mm.

In each sample, the thickness dimension of the ground electrode 14 was set to 1.3 mm, the width dimension of the ground electrode was set to 2.2 mm, the thickness dimension D1 of the second dielectric 12*b* in the discharge gap was set to 0.8 mm, and the discharge gap G1 was set to 1.1 mm. These dimensions depend on the material of the dielectric 12. In this test, alumina (having a dielectric constant ranging from 8 to 10) was used as a general dielectric 12.

The combustion evaluation test was performed on these samples using a constant volume container filled, at a pressure of 0.25 MPa, with a gaseous mixture of propane gas and air having an air fuel ratio A/F of 20 by applying a sine wave alternating current voltage of 2 ms having a frequency of 40 kHz and a voltage peak value of 20 kV. The ignition performance was evaluated by performing the combustion evaluation test five times per each sample. When ignition succeeded five times, it is indicated by a symbol "○." When miss-ignition occurred even once, it is indicated by a symbol "X." The results of the combustion evaluation test are illustrated in FIG. 20.

As illustrated in FIG. 20, because it was checked that the good ignition was observed when G2 was equal to or smaller than 0.3 mm, it is desirable that G2≤0.3 mm. It is considered that, when the gap G2 between the first dielectric 12*a* and the main fitting 13 is greater than 0.3 mm, the electric power loss due to the corona discharge occurring in a space is great and energy transferred to the discharge gap is consumed. For this reason, G2 has to be somewhat small. D2=2 mm under the condition of G2=0.3 mm.

(2) Examination on G1 and D1 (FIGS. 21 and 22)

Next, examination was performed on the thickness dimension D1 of the second dielectric 12*b* and the discharge gap G1 at a location where the discharge region is formed. Samples in which the gap G2 between the first dielectric 12*a* and the main fitting 13 within the main fitting 13 is set to 0.3 mm, the thickness dimension D2 of the first dielectric 12*a* is set to 2 mm, and which have different values of the thickness dimension D1 of the second dielectrics 12*b* and different values of the discharge gap G1 in the discharge region of a tip end of the ignition plug were manufactured, and a voltage-withstanding test and a combustion evaluation, test, were performed.

In the voltage-withstanding test, voltage was applied for one minute, and it was checked whether or not the second dielectric 12*b* is penetrated. The combustion evaluation test was performed in the same manner as described above. The results of the voltage-withstanding test are illustrated in FIG. 21, and the results of the combustion evaluation test are illustrated, in FIG. 22. When the second dielectric is not penetrated, it is indicated, by a symbol "○," and when the second dielectric is penetrated, it is indicated by a symbol "X" in FIG. 21.

From the results illustrated in FIGS. 21 and 22, it is determined that the suitable thickness dimension D1 of the second dielectric 12*b* in the discharge region is 6 mm≤D1≤1.2 mm and the suitable discharge gap G1 is 0.8 mm≤G1≤1.5 mm. The thickness dimension D1 of the second dielectric 12*b* and the discharge gap G1 at a location where the discharge gap is formed are factors that have an influence on the mechanical fracture of the second dielectric 12*b* due to the voltage application and the intensity of the discharge in the discharge space. When the above-described conditions are satisfied, respective performances are compatible at a high level.

(3) Examination on Shape of Tip End Portion of Ignition Plug (FIG. 24)

Next, examination was performed on the shape of the ground electrode 14 of the tip end portion of the ignition plug. It is assumed that the area of the end surface 13*b* of the main fitting 13 to which the ground electrode 14 is connected is S1, and the area of the end surface 13*b*, which is occupied by the ground electrode 14 when the ground electrode 14 is projected onto the end surface 13*b*, is S2. The area of the hatched line portion In FIG. 23(*a*), is S1 and the area of the hatched line portion in FIG. 23(*b*) is S2.

Samples in which S1 is always set to 39.4 $mm^2$, and the values of S2 are different from each other were manufactured, and the combustion evaluation test was performed. As other dimensions in each sample, the thickness dimension D1 of the second dielectric 12*b* in the discharge gap was set to 0.8 mm, the discharge gap G1 was set to 1.1 mm, the gap G2 between the first dielectric 12*a* within the main fitting 13 and the main fitting 13 was set to 0.3 mm, and the thickness dimension D2 of the first dielectric 12*a* was set to 2 mm (hereinafter, D1=0.8 mm, D2=2 mm, G1=1.1 mm, and G2=0.3 mm will be referred to as basic sample dimensions).

The combustion evaluation test was performed on these samples in the conditions and evaluation methods similar to those described above, using a constant volume container filled, at a pressure of 0.25 MPa, with gaseous mixtures of propane gas and air, the air fuel ratios A/F of which are 20, 22, and 24, respectively. The results of the combustion evaluation test are illustrated in FIG. 24.

From the results illustrated in FIG. 24, it is determined that 0.15≤S2/S1≤0.35 is suitable. According to an increase in the area S2 occupied by the ground electrode 14, an anti-inflammation action tends to occur and the ignition performance tends to be degraded. On the other hand, when S2 is decreased too much, because a portion where the electric field is concentrated is small, the discharge is not spread, and the ignition performance is degraded. For this reason, there is an optimal value for the area S2 of the ground electrode 14, and when 0.15≤S2/S1≤0.35, the ignition is enabled even in the condition in which the air fuel ratio A/F is 22.

(4) Examination on Number of Division of Ground Electrode (FIGS. 26 and 27)

Next, examination was performed on the suitable number of rod-shaped ground electrodes 14. In the case where the area S2 is the same, when the ground electrode 14 is divided into a plurality of small ground electrodes, the range of the discharge region 15 is increased, and thus the ignition performance is improved. The hatched line portions in FIG. 25 indicate the area S2 when the ground electrode 14 is divided into four ground electrodes. In the basic sample dimensions described above, samples in which S1 was set to 39.4 $mm^2$, values of S2/S1 were set to have two types of 0.15 and 0.35, and the numbers of division of ground electrodes 14 were set to 1, 2, and 4, were manufactured and the combustion evaluation test was performed. The other conditions and evaluation methods for the combustion evaluation test were as described above.

FIG. 26 illustrates the results of the combustion evaluation test in the case where S2/S1=0.15, and FIG. 27 illustrates the results of the combustion evaluation test in the case where S2/S1=0.35. In either case, the ground electrode 14 was divided into two or more ground electrodes, and thus the ignition was enabled even in a condition in which an air fuel ratio A/F is 24. From this, it is determined that it is desirable to divide the ground electrode 14 into a plurality of ground electrodes.

(5) Examination on Shape of Pointed End Portion of Ground Electrode (FIG. 29)

Next, examination was performed on a shape of the pointed end portion of the ground electrode 14. As described above in embodiment 3, when the first protrusion 16 having pointed end portion is provided on the ground electrode 14 at a location facing a discharge region, the ignition performance is improved. In this test, samples were manufactured in which each of four ground electrodes 14 has a thickness dimension of 1.3 mm and a width dimension of 2.2 mm and angles of pointed end portions are 45 degrees, 90 degrees, and 135 degrees, respectively.

FIG. 28A illustrates a ground electrode having pointed end portion having an angle of 45 degrees. FIG. 28B illustrates a ground electrode having a pointed end portion having an angle of 90 degrees. FIG. 28C illustrates a ground electrode having a pointed end portion having an angle of 135 degrees. Regarding the basic sample dimensions described above, S1 was set to 39.4 $mm^2$. Conditions and evaluation methods for the combustion evaluation test were as described above except that the air fuel ratio A/F was set to 24 and 26. The results of the combustion evaluation test are illustrated in FIG. 29.

From the results illustrated in FIG. 29, it is determined that, when the angle of the pointed end portion of the ground electrode 14 is equal to or smaller than 90 degrees, the electric field concentration effect described above in the embodiment 3 (FIGS. 10A and 10B), is strong and the ignition performance is improved. Alternatively, it is conceivable that, as the pointed end portion of the ground electrode 14 becomes thinner, the anti-inflammation effect by the electrode is suppressed and the ignition performance is also improved. Therefore, it is preferable that the angle of the pointed end portion of the ground electrode 14 is equal to or smaller than 90 degrees.

Embodiment 5

FIGS. 30A and 30B illustrate a cross-sectional view and a bottom view diagram illustrating an ignition plug according to embodiment 5 of the present invention. FIGS. 31 to FIGS. 33A and 33B are views respectively illustrating modifications of the ignition plug according to embodiment 5. As illustrated in FIG. 30, an ignition plug 1A according to embodiment 5 includes a rod-shaped high voltage electrode 11, a first dielectric 12*a* that covers the peripheral surface 11*a* of the high voltage electrode 11, a cylindrical main fitting 13, and a mesh-like ground electrode 14A disposed so as to surround the end portion 11*c* of the high voltage electrode 11.

The main fitting 13, which is a case of the ignition plug 1, has a threaded portion 13*a* in the peripheral surface thereof, and is fixed inside a partition wall 21 that faces a combustion chamber 22 of an engine. The mesh-like ground electrode 14A is connected to one end surface 13*b* of the main fitting 13. The main fitting 13 and the ground electrode 14A have the same ground electric potential as the engine.

Furthermore, the peripheral surface 11*a* of the rod-shaped high voltage electrode 11, which is covered with the first dielectric 12*a*, is held in the main fitting 13, and one end portion 11*c* thereof is exposed from the end surface 13*b* side of the main fitting 13.

The end portion 11*c* of the high voltage electrode 11 is covered with the second dielectric 12*b*, and the end portion 11*c* of the high voltage electrode 11 and the ground electrode 14A are disposed to face each other with the discharge region 15 facing the second dielectric 12*b* being interposed therebetween.

In order to directly ignite fuel by the barrier discharge, it is necessary to cause a fuel gas to flow into the discharge region, and it is also necessary to cause the discharge to be concentrated to a certain degree. In order to perform multi-point ignition, it is necessary to cause the discharge to occur at a plurality of locations at the same time. Furthermore, in order to suppress the anti-inflammation effect at the time of ignition, it is necessary to decrease the thermal capacity of the ground electrode. The mesh-like ground electrode 14A satisfies all of these requirements.

In the case of the barrier discharge, the consumption of an electrode due to the discharge hardly occurs. Thus, the ground electrode 14A, which is a metal electrode, can be made thin to such an extent that the electrode can maintain the mechanical strength. In the case of the mesh-like ground electrode 14A, the mechanical strength can be maintained even if the electrode is made sufficiently thin. However, a predetermined thickness need to be secured considering that the electrode is heated due to the combustion. Furthermore, because the fuel gas flows into and out of the mesh, the mesh-like ground electrode 14A is suitable for the direct ignition of the fuel. Moreover, because concentration of the electric field occurs at a plurality of intersection points on the mesh-like ground electrode 14A, the concentrated discharge can be generated at a plurality of locations.

In embodiment 5, the barrier discharge is initiated in the vicinity of the shortest distance between the intersections on the mesh-like ground electrode 14A and the dielectric electrode facing the intersections, and is spread therearound. Because many intersections are distributed, many discharges occur between the respective intersection points and the second dielectric 12*b*, and a volumetric discharge occurs in almost all the area between the mesh-like ground electrode 14A and the dielectric electrode.

As illustrated in FIGS. 30A and 30B, by disposing the mesh-like ground electrode 14A around the dielectric electrode substantially concentrically, it is possible to cause the discharge to occur in a wide area. On the other hand, as illustrated in FIG. 31, by making the tip end portion of the ground electrode 14A gradually thinner, it is possible to cause the combustion to be initiated in the vicinity of the tip end portion of the ignition plug 1A, that is, near the center of the combustion chamber 22.

Figure 31:
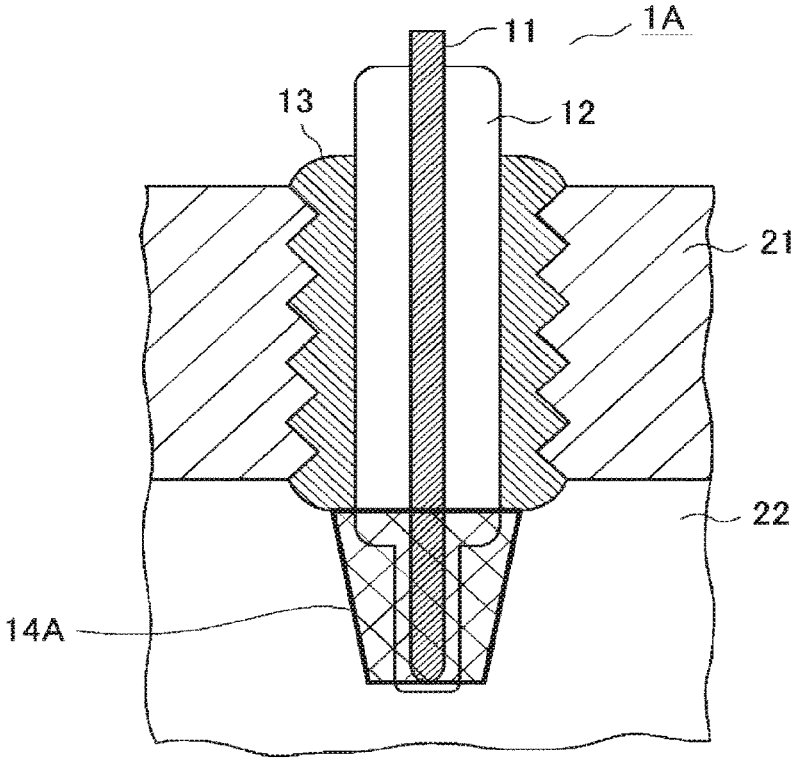
FIG. 31 is a cross-sectional view illustrating the ignition plug according to embodiment 5 of the present invention.
Figure 32:
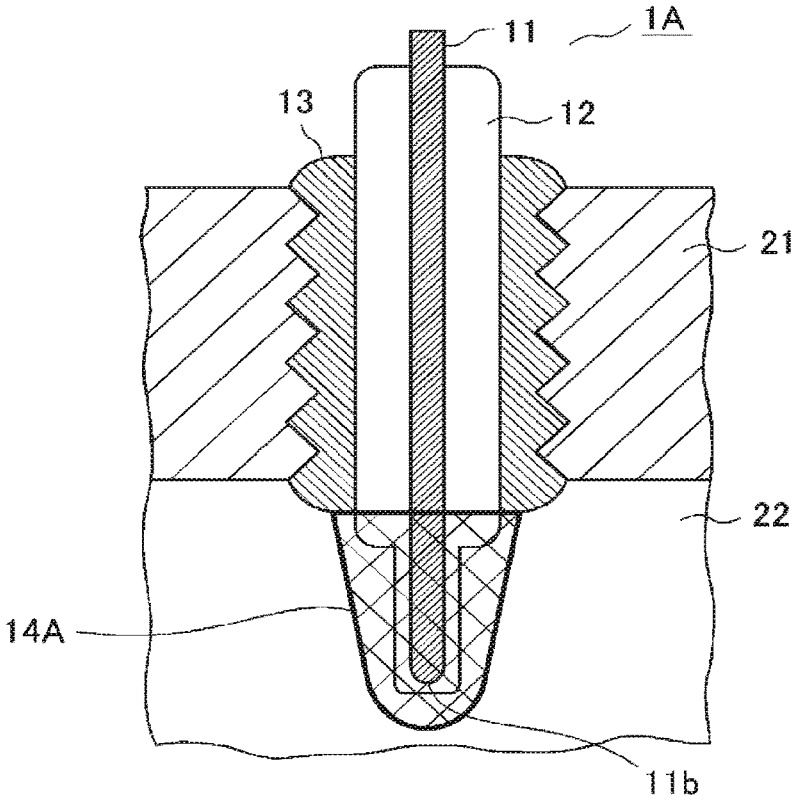
FIG. 32 is a cross-sectional view illustrating the ignition plug according to embodiment 5 of the present invention.

The ground electrode 14A illustrated in FIG. 32 has a tip end portion that is made gradually thinner as in FIG. 31, and covers the dielectric electrode up to the tip end thereof. With this configuration, it is possible to cause the combustion to be initiated in the vicinity of the tip end of the ignition plug 1A, and the mechanical strength of the mesh-like electrode is improved.

Figure 33A:
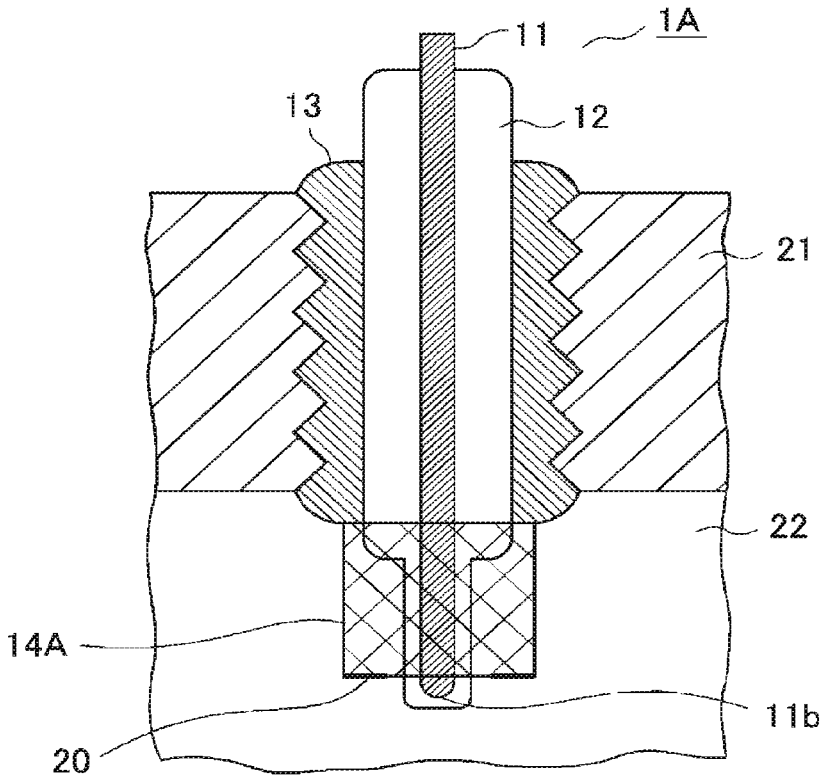
FIG. 33A and FIG. 33B illustrate a cross-sectional view and a bottom view of the ignition plug according to embodiment 5 of the present invention.
Figure 33B:
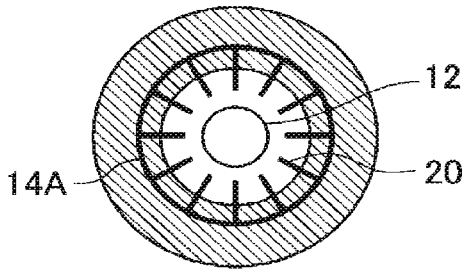

Moreover, in the example illustrated in FIGS. 33A and 33B, the ground electrode 14A has a cylindrical shape, in which one end portion of the ground electrode 14A is connected to the main fitting 13, and the other end portion has a plurality of protrusion electrodes 20 protruding into the discharge region. With this configuration, because the discharge occurs not at the mesh-like portion of the ground electrode 14A but at the protrusion electrodes 20 on the tip end portion of the ground electrode, it is possible to cause the combustion to be initiated to be concentrated in the vicinity of the tip end portion of the ignition plug 1A.

In the ignition plug 1A according to embodiment 5 as well, sufficiently strong radicals can also be generated locally by the barrier discharge as in embodiment 1, and the radicals can react with fuel so as to ignite the fuel simultaneously with the occurrence of the discharge. Moreover, because the ground electrode 14 has the thin mesh-like shape, the anti-inflammation effect by the electrode is small and it is difficult to hinder the growth of the flame. In addition, the fuel gas introduced into the combustion chamber 22 is liable to flow into the discharge region, and is easily ignited by the radicals generated by the discharge.

From these, according to embodiment 5, the direct ignition of fuel can be stably performed using a barrier discharge, and an ignition plug 1A capable of realizing excellent ignitability and combustibility and an ignition system including the ignition plug 1A can be obtained. Within the scope of the present invention, respective embodiments of the present invention may be freely combined, or may be properly modified or omitted within the scope of the present invention.

The invention claimed is:

1. An ignition plug comprising:

a cylindrical main fitting;

a rod-shaped ground electrode connected to one end surface of the main fitting;

a rod-shaped high voltage electrode, one end portion of which is exposed from the end surface side of the main fitting; and a first dielectric covering a peripheral surface of the high voltage electrode and held in the main fitting, wherein the end portion of the high voltage electrode is covered with a second dielectric that has a thickness dimension smaller than a thickness dimension of the first dielectric, and wherein the end portion of the high voltage electrode and the ground electrode are disposed to face each other with a discharge region facing the second dielectric being interposed therebetween, a thickness dimension of the second dielectric facing the discharge region is uniform, and, an area of the ground electrode facing the discharge region is smaller than a surface area of the second dielectric facing the discharge region, wherein, assuming that an area, S1, of the end surface of the main fitting is S1 and an area of the end surface, which is occupied by the ground electrode when the ground electrode is projected onto the end surface is S2, $0.15 \leq (S2/S1) \leq 0.35$.

2. The ignition plug according to claim 1, wherein the ground electrode is a plurality of rod-shaped electrodes.

3. The ignition plug according to claim 1, wherein the ground electrode has a bent portion bent toward the high voltage electrode.

4. The ignition plug according to claim 1, wherein the ground electrode includes a first protrusion having a pointed end portion at a location thereon facing the discharge region.

5. The ignition plug according to claim 4, wherein the ground electrode is a metal electrode, and an angle of the pointed end portion is equal to or smaller than 90 degrees.

6. The ignition plug according to claim 1, further comprising:

a small metal piece provided on the second dielectric covering the end portion of the high voltage electrode at a location facing the discharge region.

7. The ignition plug according to claim 1, wherein assuming that a thickness dimension of the second dielectric covering the end portion of the high voltage electrode is D1, 0.6 mm≤D1≤1.2 mm, and assuming that the shortest distance between the second dielectric covering the end portion of the high voltage electrode and the ground electrode is G1, 0.8 mm≤G1≤1.5 mm.

8. An ignition system comprising;

the ignition plug according to claim 1, an alternating current application unit configured to apply an alternating current voltage between the high voltage electrode and the ground electrode of the ignition plug so as to cause a dielectric barrier discharge to occur in the discharge region, wherein the main fitting is fixed inside a partition wall that faces a combustion chamber of an engine, and the end portion of the high voltage electrode and the ground electrode are disposed to face each other within the combustion chamber.

9. An ignition plug comprising:

a cylindrical main fitting;

a rod-shaped ground electrode connected to one end surface of the main fitting;

a rod-shaped high voltage electrode, one end portion of which is exposed from the end surface side of the main fitting; and a first dielectric covering a peripheral surface of the high voltage electrode and held in the main fitting, wherein any one of the end portion of the high voltage electrode and the ground electrode is covered with a second dielectric having a thickness dimension smaller than a thickness dimension of the first dielectric, and wherein the end portion of the high voltage electrode and the ground electrode are disposed to face each other with a discharge region facing the second dielectric being interposed therebetween, the thickness dimension of the second dielectric facing the discharge region is uniform, and, assuming that a distance of a gap between the first electric covering the peripheral surface of the high voltage electrode and the main fitting is G2, G2≤0.3 mm.

10. The ignition plug according to claim 9, wherein the ground electrode is a plurality of rod-shaped electrodes.

11. The ignition plug according to claim 9, wherein the ground electrode has a bent portion bent toward the high voltage electrode.

12. The ignition plug according to claim 9, wherein the ground electrode includes a first protrusion having a pointed end portion at a location thereon facing the discharge region.

13. The ignition plug according to claim 12, wherein the ground electrode is a metal electrode, and an angle of the pointed end portion is equal to or smaller than 90 degrees.

14. The ignition plug according to claim 9, wherein the end portion of the high voltage electrode includes a second protrusion having a pointed end portion at a location facing the discharge region.

15. The ignition plug according to claim 9, further comprising:

a small metal piece provided on the second dielectric covering any one of the end portion of the high voltage electrode and the ground electrode at a location facing the discharge region.

16. The ignition plug according to claim 9, wherein assuming that a thickness dimension of the second dielectric covering the end portion of the high voltage electrode is D1, 0.6 mm≤D1≤1.2 mm, and assuming that the shortest distance between the second dielectric covering the end portion of the high voltage electrode and the ground electrode is G1, 0.8 mm≤G1≤1.5 mm.

17. The ignition plug according to claim 9, wherein, assuming that an area of the end portion of the main fitting is S1 and an area of the end surface, which is occupied by the ground electrode when the ground electrode is projected onto the end surface is S2, 0.15≤S2/S1≤0.35.

18. An ignition system comprising;

the ignition plug according to claim 9;

an alternating current application unit configured to apply an alternating current voltage between the high voltage electrode and the ground electrode of the ignition plug so as to cause a dielectric barrier discharge to occur in the discharge region, wherein the main fitting is fixed inside a partition wall that faces a combustion chamber of an engine, and the end portion of the high voltage electrode and the ground electrode are disposed to face each other within the combustion chamber.

19. An ignition plug comprising:

a cylindrical main fitting;

a rod-shaped ground electrode connected to one end surface of the main fitting;

a rod-shaped high voltage electrode, one end portion of which is exposed from the end surface side of the main fitting; and a first dielectric covering a peripheral surface of the high voltage electrode and held in the main fitting, wherein any one of the end portion of the high voltage electrode and the ground electrode is covered with a second dielectric having a thickness dimension smaller than a thickness dimension of the first dielectric, and wherein the end portion of the high voltage electrode and the ground electrode are disposed to face each other with a discharge region facing the second dielectric therebetween, and a third protrusion having a pointed end portion is provided on the second dielectric at a location facing the discharge region.

20. The ignition plug according to claim 19, wherein the ground electrode is a plurality of rod-shaped electrodes.

21. The ignition plug according to claim 19, wherein the ground electrode includes a first protrusion having a pointed end portion at a location thereon facing the discharge region.

22. The ignition plug according to claim 21, wherein the first protrusion and the third protrusion are disposed in such a manner that a distance interconnecting respective pointed end portions of the first protrusion and the third protrusion is a shortest distance in the discharge region.

23. An ignition system comprising;

the ignition plug according to claim 19;

an alternating current application unit configured to apply an alternating current voltage between the high voltage electrode and the ground electrode of the ignition plug so as to cause a dielectric barrier discharge to occur in the discharge region, wherein the main fitting is fixed inside a partition wall that faces a combustion chamber of an engine, and the end portion of the high voltage electrode and the ground electrode are disposed to face each other within the combustion chamber.

* * * * *